US012509897B2

(12) United States Patent
Pisapati

(10) Patent No.: US 12,509,897 B2
(45) Date of Patent: Dec. 30, 2025

(54) POOL SAFETY SYSTEM

(71) Applicant: Skyrama Innovation LLC, Lansdale, PA (US)

(72) Inventor: Kalyan Pisapati, Lansdale, PA (US)

(73) Assignee: Skyrama Innovation LLC, Lansdale, PA (US)

( * ) Notice: Subject to any disclaimer, the term of this patent is extended or adjusted under 35 U.S.C. 154(b) by 0 days.

(21) Appl. No.: 19/009,887

(22) Filed: Jan. 3, 2025

(65) Prior Publication Data

US 2025/0382810 A1 Dec. 18, 2025

Related U.S. Application Data

(60) Provisional application No. 63/659,709, filed on Jun. 13, 2024.

(51) Int. Cl.
*E04H 4/06* (2006.01)

(52) U.S. Cl.
CPC ..... *E04H 4/065* (2013.01)

(58) Field of Classification Search
CPC ..... E04H 4/06; E04H 4/065; E04H 4/103
USPC ..... 4/495, 499, 501, 504, 505
See application file for complete search history.

(56) References Cited

U.S. PATENT DOCUMENTS 1,091,909 A 3/1914 Birmingham
3,000,017 A * 9/1961 Skovira ..... E04H 4/065 4/504
3,816,859 A 6/1974 Mosehauer
4,129,905 A * 12/1978 Niemirow ..... E04H 4/103 4/501
5,832,547 A 11/1998 Burroughs
6,127,930 A * 10/2000 Steffanus ..... E04H 4/103 4/495
6,574,804 B1 * 6/2003 Boujon ..... E04H 4/065 4/504
7,479,891 B2 * 1/2009 Boujon ..... E04H 4/065 342/126

FOREIGN PATENT DOCUMENTS

CN 101230755 A 7/2008
CN 102417022 B 12/2013
CN 109594806 A * 4/2019 ..... E04H 4/00
CN 109594806 B 11/2020
(Continued)

OTHER PUBLICATIONS

Laxman, Jain, Robust Drown Alerting, Preventing and Autonomous Rescue System, Scientific Bulletin of the Electrical Engineering Faculty—Year 21 No. 1 (44), India.
(Continued)

*Primary Examiner* — Tuan N Nguyen
(74) *Attorney, Agent, or Firm* — Muskin and Farmer LLC

(57) ABSTRACT

A method, system, and computer readable storage to implement a swimming pool safety system. The safety system includes one or more inflatable nets (modules) which normally rest on the bottom of the pool. When a swimmer is in distress, the inflatable net that is closest to the swimmer can manually or automatically be instructed to inflate. Upon receiving the instruction to inflate, the net would inflate and then rise to the top of the pool, thereby taking the distressed swimmer to the surface of the pool where he or she can be rescued.

20 Claims, 38 Drawing Sheets

(56) References Cited

FOREIGN PATENT DOCUMENTS

| | | | |
|---|---|---|---|
| CN | 212766693 | U | 3/2021 |
| FR | 2505914 | A1 | 5/1981 |
| FR | 2910036 | B1 | 2/2009 |
| FR | 3036420 | A1 | 5/2021 |
| WO | WO2003015046 | A1 | 2/2003 |
| WO | WO2014194921 | A1 | 11/2014 |

OTHER PUBLICATIONS

PCT International Search Report, PCT/US2025/032574, dated Aug. 28, 2025.

* cited by examiner

Reference points on pool schematic help users quickly identify the correct inflatable net module To enable maintenance and play modes, responsible individuals have to select the appropriate mode to prevent accidental switch over from Watch and Protect modes

B-B

B-B

POOL SAFETY SYSTEM

CROSS REFERENCE TO RELATED APPLICATIONS

This application claims benefit to U.S. provisional application 63/659,709, which is incorporated by reference here in its entirety.

BACKGROUND OF THE INVENTION

Field of the Invention

The present general inventive concept is directed to a method, apparatus, and computer readable storage medium directed to a swimming pool safety system.

Description of the Related Art

The Centers for Disease control (CDC) is a United States federal agency under the Department of Health and Human Services. According to the CDC, drowning is the leading cause of death for children. More children ages 1-4 die from drowning than any other cause of death. Children ages 1-4 have the highest drowning rates. Most drownings in children of that age group happen in swimming pools. For children ages 5-14, drowning is the second leading cause of unintentional injury death after motor vehicle crashes. For every child under age 18 who dies from drowning, another 7 receive emergency department care for nonfatal drowning. Drowning can happen to anyone, anytime there is access to water. According to some estimates, 40 million adults in the US do not know how to swim. Over half (55%) of U.S. adults have never taken a swimming lesson. Adults 65 years of age and older had the second highest rate of drowning. Every year in the United States, there are over 4,000 fatal unintentional drownings and 8,000 non fatal drownings. According to US Consumer Product Safety Commission (CPSC), residential locations such as child's home, a family or friend's house or neighbor's residence made up 71 percent of the reported fatal drowning incidents. Children younger than 5 years old accounted for 75 percent of child drownings between 2015 and 2017, 56 percent of which were attributed to a gap in adult supervision.

Globally, drowning is the third leading cause of unintentional injury death, claiming about 236,000 lives each year. Over 90% of drowning deaths occur in low- and middle-income countries, with children under the age of five at highest risk.

Drowning can happen even when children are not expected to be near water, such as when they access the pools without competent adult supervision. Drowning happens in seconds and is often silent. Drowning can be fatal or nonfatal. Nonfatal drowning has a range of outcomes or results, from no injuries to very serious injuries such as brain damage or permanent disability.

The current safety recommendations such as building fences that enclose the pools, supervision of the kids closely, wearing a life jacket etc. reduces the incidents of the drownings. Clearly, either the recommendations are not fully followed or those are not enough to prevent the fatal and nonfatal drownings.

What is needed is an additional mechanism to improve pool safety.

SUMMARY OF THE INVENTION

It is an aspect of the present invention to provide a swimming pool safety device.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
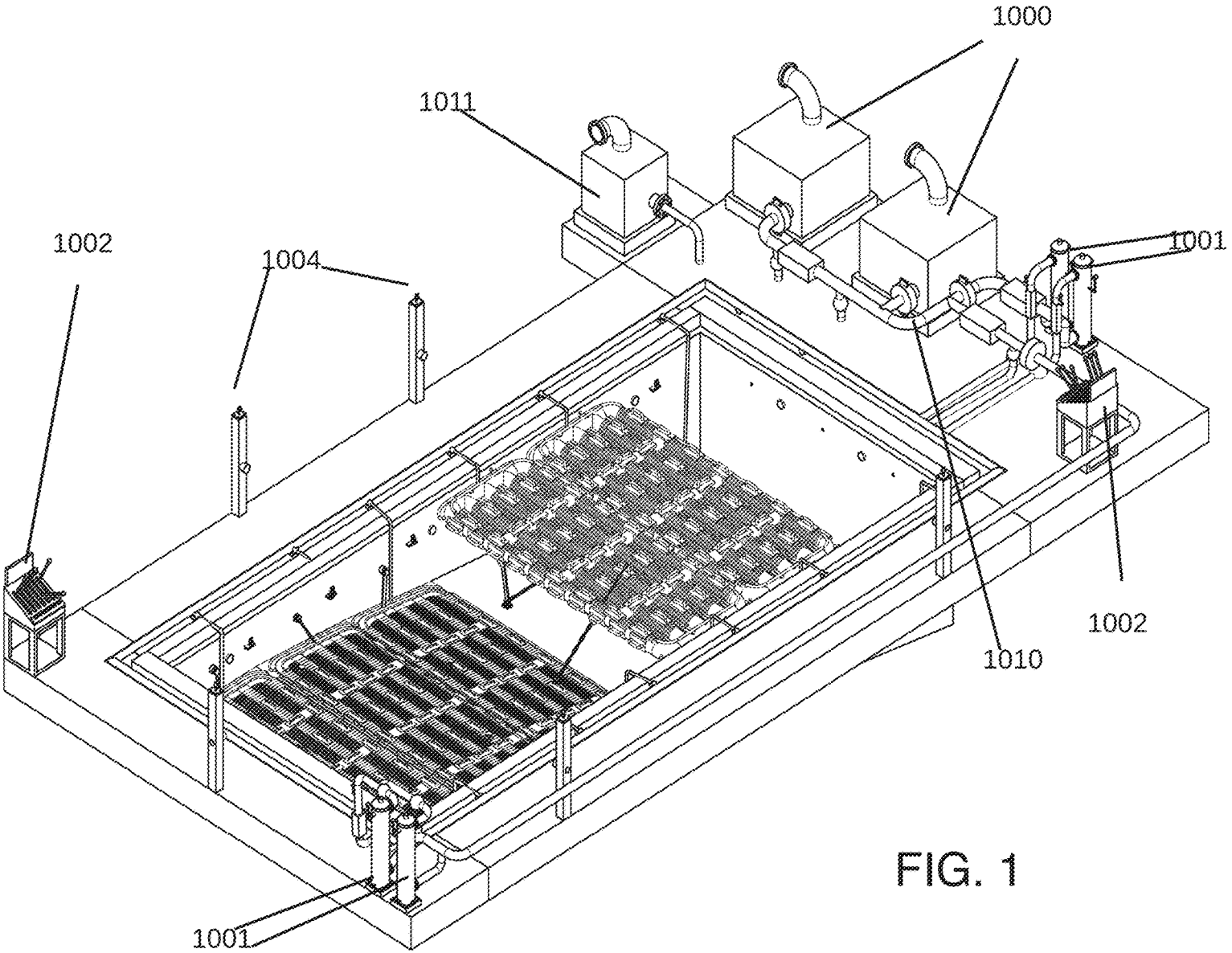
FIG. 1 is drawing of a pool with a safety system, according to an embodiment.

Reference will now be made in detail to the presently preferred embodiments of the invention, examples of which are illustrated in the accompanying drawings, wherein like reference numerals refer to like elements throughout.

The general inventive concept relates to a safety system to help prevent drowning in swimming pools. Embodiments include a reusable inflatable net that is securely attached to a floor and sides of a swimming pool. In a watch mode, the inflatable net is not inflated and remains on the floor of the swimming pool and will not be an hinderance, obstacle or an inconvenience to the swimmers. In a protect mode, when a swimmer or a pet is in danger of drowning, a respective inflatable net is rapidly inflated by the action of air moving devices (such as blowers, compressors or fans) and pressurized air stored in the storage tanks. The inflatable net rises to the surface lifting/raising the human(s) and or pet(s) that have drowned or are in danger of drowning to the surface of the water thereby preventing a potential tragic event. The inflatable net can be modular in nature and can be divided into sections/zones to allow for the activation of the air moving devices and inflatable net in the dedicated zones/sections of the swimming pool where there is a potential or actual drowning incident at that point of time.

The modular design of the inflatable net will allow for easy maintenance and pool cleaning and provides flexibility to the pool owner to install inflatable net in only certain areas/sections of the pool. After the humans and pets are out of danger and safely brought out of the pool, a responsible adult or individual(s) who can determine the safety aspects in the pool area can manually reset the inflatable net by activating the required controls and switches to initiate the suction of the air by the air moving devices from the inflatable net for deflating it. After deflation and system reset, the inflatable net will rest on the floor of the swimming pool ready to protect the people and pets.

The inflatable net and the air moving devices can be activated by any of the following methods-manual activation switches/levers, cameras and microphones located in the pool area, control system that receives and evaluates live video and audio through the use of machine learning and artificial intelligence technology, electronic wearable such as pendant, bracelet or smart watch worn by the swimmer, a remote operator monitoring the pool and swimmer's primary vital signs.

In an embodiment, a modular and reusable inflatable net is securely attached to the floor and sides of the swimming pool. The inflatable net can be rapidly inflated due to a potential drowning incident or an actual drowning incident in a swimming pool. The inflated net would then cause the human (or pet) that was drowning to rise to the top of the pool, where he/she could breathe air and be more easily rescued. After the human or pet is out of danger and is safely out of the pool, an operator of the system who can determine the safety aspects in the pool area can reset the system to deflate the inflatable net.

The inflatable net comprises several large inflatable tubes, air chambers and a lattice structure of interlaced smaller size inflatable tubes to provide buoyancy and stability required to raise and support several humans and pets from below the water level to at or above water level thereby preventing the human(s) or pet(s) from drowning. The system can include compressed air ballast tanks located at various locations to provide additional buoyancy and stability if required. The air in the ballast tanks could be monitored and adjusted based on the location of the load (humans or pets) to provide required buoyancy and stability.

FIG. 1 is drawing of a pool with a safety system, according to an embodiment.

A swimming pool is shown without water for illustrative purposes, although typically it would be filled with water. A plurality of compressors 1000 would be used to fill a plurality of compressed air tanks 1001 with compressed air via air compressor conduits 1010. The air tanks 1001 are used to inflate modules which normally sit deflated on the bottom of the pool and when inflated, will rise to the top of the pool A distressed swimmer can be brought to the surface of the pool by inflating a module the distressed swimmer is located over. Control panels 1002 are used to control the system. A plurality of video cameras 1004 (also referred to herein as video cameras 2600) are positioned around the swimming pool in order to capture real time video of swimmers. Artificial intelligence can be used to monitor the real-time videos from the video cameras 1004 and can automatically identify when a swimmer is distressed in order to automatically raise the respective module. A respective module can be raised by opening a valve (such as an air valve or a control valve) which allows air from a compressed air tank to flow into the module via air supply piping. When it is time to deflate the module, the blower(s)/fans 1011 can be activated to deflate the module by pumping air out of the module via suction piping which can be exhausted into the air. The valves used to control air flow can be any type of air valve or control valve, which can be electronically controlled (e.g., a solenoid valve, electro pneumatic valve) and can optionally be a check valve (to allow air flow in only one direction).

The air tanks, compressors, blowers, etc., can be installed either on a steel skid (welded or bolted structural steel members) supported on a common concrete foundation or could have independent foundations for support. The type, number and location of the foundations can be dependent on the available space, number of air moving devices, number of swimming pools, type of soil at the location of pool or surrounding areas. The air tanks, compressors, blowers, etc., could have noise enclosures, insulation and cladding, anti-vibration dampening pads, silencers and flexible connectors to dampen the sound (noise) during operation if the sound levels are higher than acceptable level to meet the pool owner's or location requirements. Dryers can be a separate component or integral to compressor and can be used in order to remove humidity from the outside air before the pressurized air is piped to the air storage tank(s). The dryer would typically be in the flow path between the compressor and the air storage tank.

Note that all of the components (devices described herein such as blowers, compressors, valves, sensors, processors, air tanks, control boxes, etc.) should all be located at the pool site (the pool site can be defined as within 1000 feet of the perimeter of the pool).

Note that a pool can be any depth, for example from 5 feet to 15 feet deep (or more). The module(s) would typically rest at the bottom (floor) of the pool, and would rise when inflated with air (and automatically sink back down to the bottom when deflated). Thus, each module(s) would rise from 5 to 15 feet from the bottom when inflated. Each module would be inflated and deflated individually using valves to direct the air flow.

Figure 2:
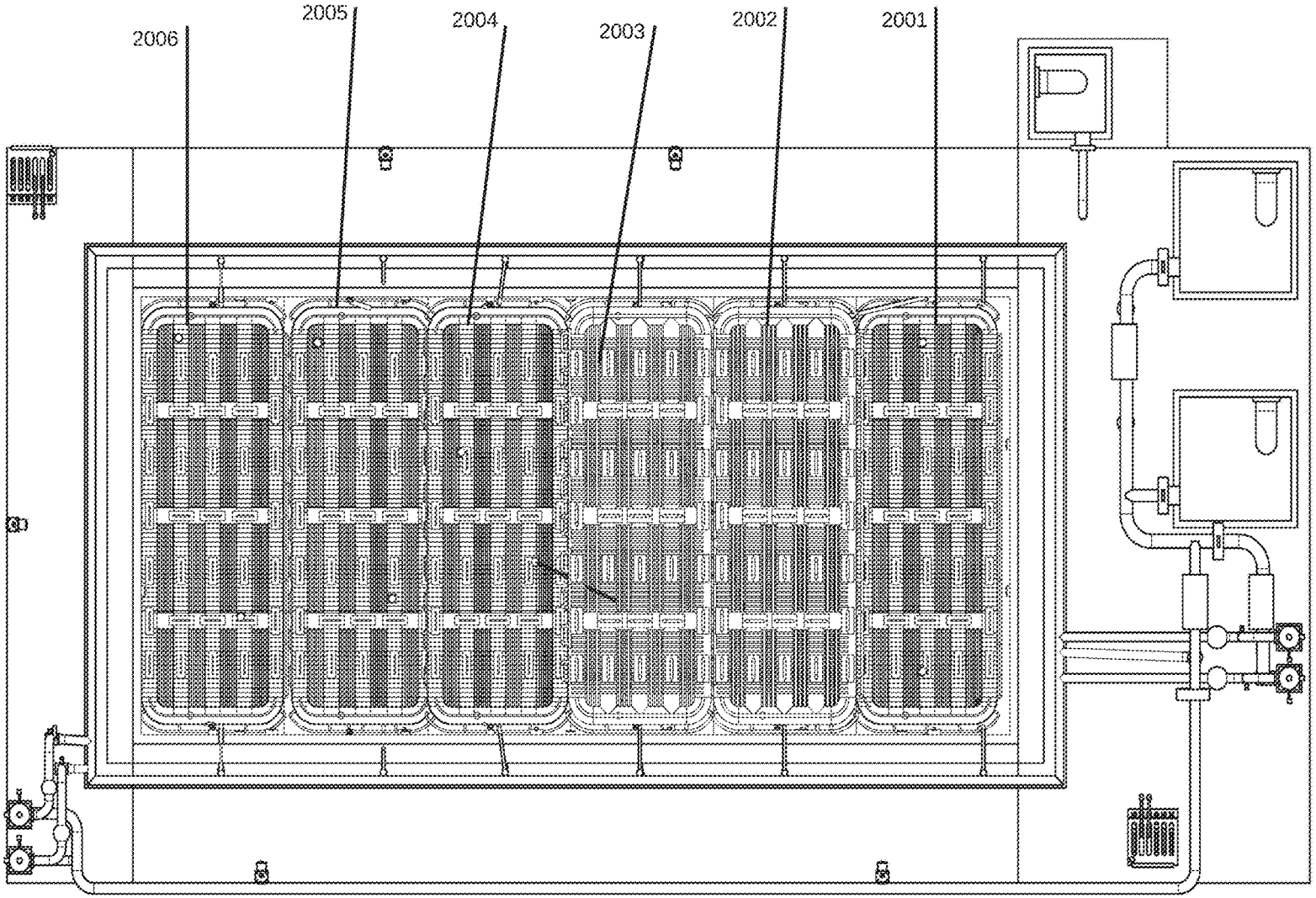
FIG. 2 is a drawing of a top-down view of a pool with a safety system, according to an embodiment.

FIG. 2 is a drawing of a top-down view of a pool with a safety system, according to an embodiment.

A plurality of modules 2001, 2002, 2003, 2004, 2005, 2006 are located inside the pool, although any number modules can be used (e.g., 1 to 10 or more). Each module would typically sit at the bottom of the pool (when the system is in the watch mode) and can be individually raised to the top of the pool in the protect mode. In the watch mode, when a problem occurs (such as a distressed swimmer), then only the particular module that the distressed swimmer is over would only be raised (automatically or also manually).

Figure 3:
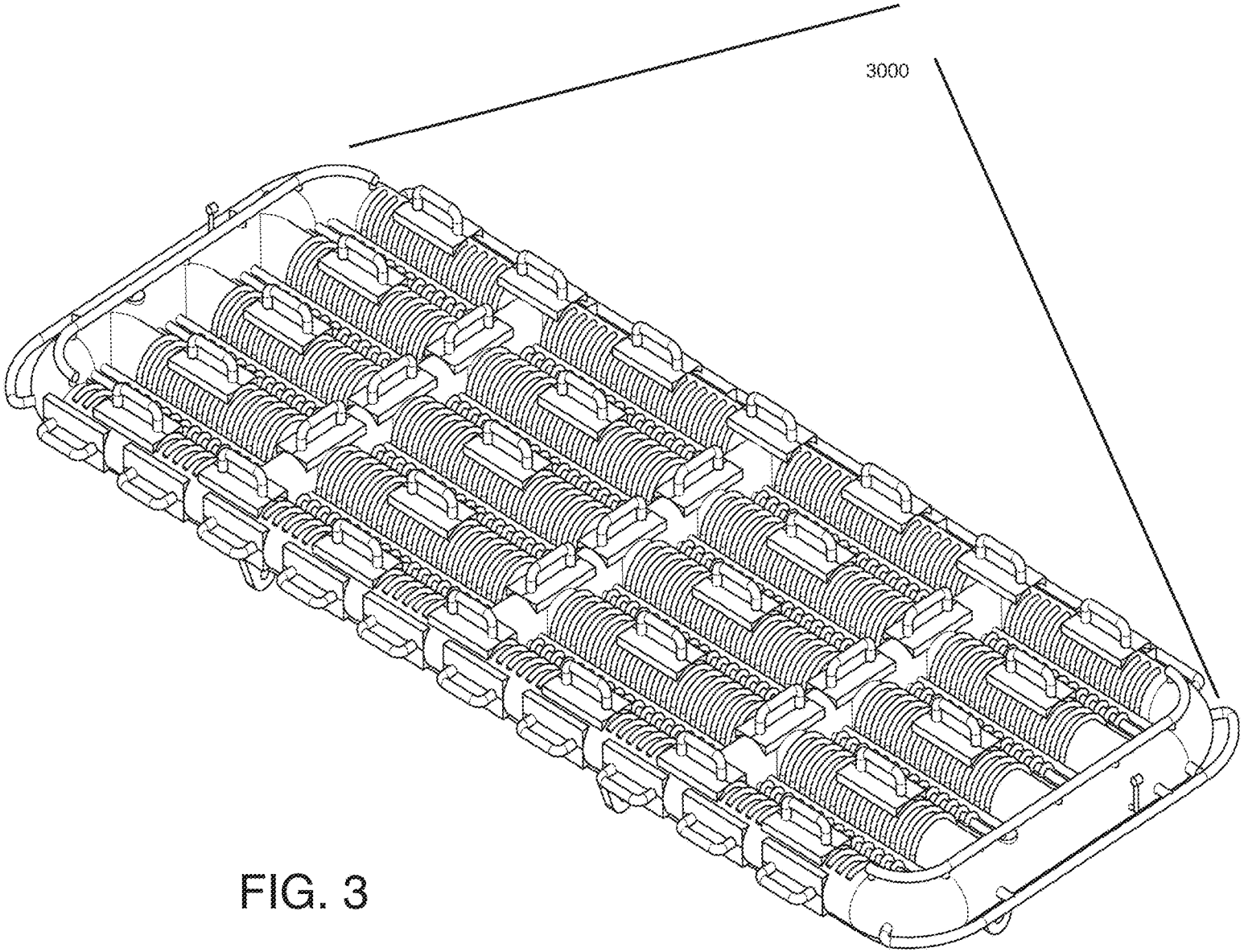
FIG. 3 is a drawing of an inflated net module, according to an embodiment.

FIG. 3 is a drawing of an inflated net module, according to an embodiment. An inflated module 3000 is inflated by using air from the air storage tank(s).

The inflatable net can be made of a variety of materials but not limited to Natural and synthetic rubbers, Polyurethanes (PU) and Polyvinylchlorides (PVC). The material of the inflatable net should typically be lighter so that one or two adults can move and position the uninflated inflatable net modules into position or lift it up for maintenance purposes. The inflatable net is expected to be in swimming pool water for most of its service life. The material used for inflatable net should ensure it retains both aesthetic qualities and functional capabilities for several years despite prolonged and continuous exposure to sunlight (including ultra violet wave length), swimming pool water, and ambient temperatures dependent on the location of the installation. The inflatable net material could be coated with substances to enhance its resistance to environmental degradation-heat and fungus and elements. The material of inflatable net will provide adequate abrasion and puncture resistance. The inflatable module(s) can be made out of any suitable material, such as PVC, Nylon, etc. Each inflatable module is airtight and can only accept (and release) air through designated ports. As such, when inflated, each module would automatically fill with air and rise, and when deflated, each module would automatically sink back down to the bottom of the pool (due to the forces of gravity).

When a deflated module (shown in FIG. 4) is filled with air, it becomes an inflated module 3000. Note that the inflated module 3000 is filled with air and thus will naturally rise from the bottom of the pool to the top. The buoyancy of the inflated module 3000 would overcome the forces of gravity and would cause the module to rise. Handles 3000 are present throughout the module so that swimmer could grab onto while the module is rising.

The module 3000 contains a series of interconnected tubes without leaks which can be filled with air. In one embodiment, the entire module 3000 can typically be non-compartmentalized, that is, it has one continuous air chamber that does not have internal dividers. Thus, it will inflate smoothly and equally. Note that all modules can typically be the same, so any description with regard to one module would equally apply to all of the other modules in the system. Note that in another embodiment, the entire module can be compartmentalized, that is, constructed in airtight sections so that a leak in one section would not affect (e.g., cause air pressure loss) in another section. For example, an inflatable net can comprise an inside compartment and an outside compartment. The inside compartment can be hermetically separate from the outside compartment and each would have its own piping to inflate and deflate the respective compartment. As such, a leak/hole in one of these compartment would not affect the other compartment, so that such a leak/hole would not cause a failure of the inflatable net since the other compartment(s) would still function properly and cause the inflatable net to rise when inflated. Note that the inflatable nets can also be manufactured to fit the geometry of the pool, for example, if the pool is rectangular (as shown in the Figures) then the inflatable nets can also be rectangular in shape. If the pool is curved, then the inflatable nets can be curved in shape to match the geometry of the pool.

The module 3000 is connected to either rigid or flexible piping using connectors such as but not limited to valves, plugs or couplings. The connectors could either be designed specifically for this purpose or off the shelf products that are readily available. The inflatable net is connected to rigid or flexible piping for the purpose of supplying compressed air to inflate the module and suctioning the air in the inflated module to deflate the module.

A control system can monitor and adjust the air pressure of inflatable net to maintain buoyancy and stability. The modules are typically securely attached to anchors attached to the floor of the pool and the sides of the pool to prevent the modules from being a hinderance or an obstacle to the people in the swimming pool. The attachment to the anchors can also include a spring like component and/or the elastic band of material to pull the module towards to the pool floor and the sides. This serves to pull the module in its uninflated state to be closer to the floor or on the floor of the swimming pool so that the module is not an hinderance or obstacle to the swimmer or people in the pool. The spring like component and/or the elastic band would also not hinder the maintenance tasks (such as removing debris, dust, unwanted material or objects) of the swimming pool. The spring like component and/or the elastic band serves to ensure the inflatable net will not hinder the cleanup and maintenance activities of the pool. Without the spring like component and/or the elastic band, the module could then float away in the pool. As such, the spring like component and/or the elastic band keeps the uninflated module into its place, and when the uninflated module is inflated into the inflated module, the spring like component and/or the elastic band also keeps the inflated module in its place. The spring like component and/or the elastic band could be a separate component or could be an integral part of the inflatable net. The spring like component and/or the elastic band could also be part of the anchoring (securing or guiding) components that secure the inflatable net to the floor and sides of the swimming pool. Metal chains can be used instead of the spring like component or elastic band. The metal chains can be made of material that allows continuous operation in swimming pools for prolonged period without degradation due to corrosion or other factors. The spring like component or chains could be surrounded by sleeves or inflatable tubes for either aesthetic purposes or to raise and lower it during inflation and deflation processes. The air hoses to supply air to the inflatable net could be routed through the spring like component and/or the elastic band for functional and aesthetic reasons.

The module (also referred to herein as an inflatable net) is inflated by one or more air tanks (under pressure) through a network of air supply piping. Typically, when a valve connecting an air tank to the air supply piping is opened, the pressure from the air tank would automatically send the air through the air supply piping. Separate piping can be used for inflating (air supply piping) and deflating (suction piping) the modules.

Air moving devices such as fans, air pumps, blowers or compressors through a network of piping, air receivers (pressurized air storage tanks), valves and other humidity, pressure, flow/volume and temperature sensing instrumentation. The air moving devices are located outside the swimming pool and could be installed either close to the pool or at a distance from the pool depending on the pool owner's preference and space availability at the location. The number of air moving devices required is dependent on the swimming pool dimensions as well as the expected design load (expected number of humans and pets in the pool) when the inflatable net is inflated due to an actual or potential drowning incident. The inflation and deflation of the inflatable net could be accomplished by using separate air moving devices for inflating and deflating purposes or by using air moving devices that can fulfill both inflating and deflating functions.

The Inflatable net is conceptualized to be modular in nature (divided into sections or zones) to allow for easy installation, adaptation to the pool geometry (shape, size and depth) and for installation in only certain areas of the pool to suit pool owner's requirements and wishes. For example, a pool owner could choose to install the inflatable net in the deeper sections of the pool and not install the inflatable net in the shallower sections of the pool. The modular design allows for the activation of inflatable net and the air moving devices in the dedicated zones of the swimming pool where there is a potential or actual drowning incident at that point of time. This will allow any other people in a different part of the pool from being inconvenienced or lifted to the water surface if the inflated net was not modular in design. The modular design of the inflatable net allows the inflatable net not to be inflated/activated in areas of the pool where there is no active drowning incident at that point of time.

The modular design of inflatable net will facilitate easy maintenance of the inflatable net on a certain section/zone while the rest of the sections of the Inflatable net are available to protect humans and pets from drowning. The modular design of the inflatable net will ensure it is not interfering with the swimming pool maintenance activities. For example—if the pool owner wishes to use a robot cleaner to clean the entire pool floor or a certain area of the pool floor, the inflatable net modules sections/zones can be put into maintenance mode which would cause the module(s) to be inflated as required so that the inflatable net is not in the way of the robot cleaner. The number and size of air moving devices are designed accordingly to meet the air flow and pressure requirements for the installed modules (sections or zones) of the inflatable net.

Figure 4:
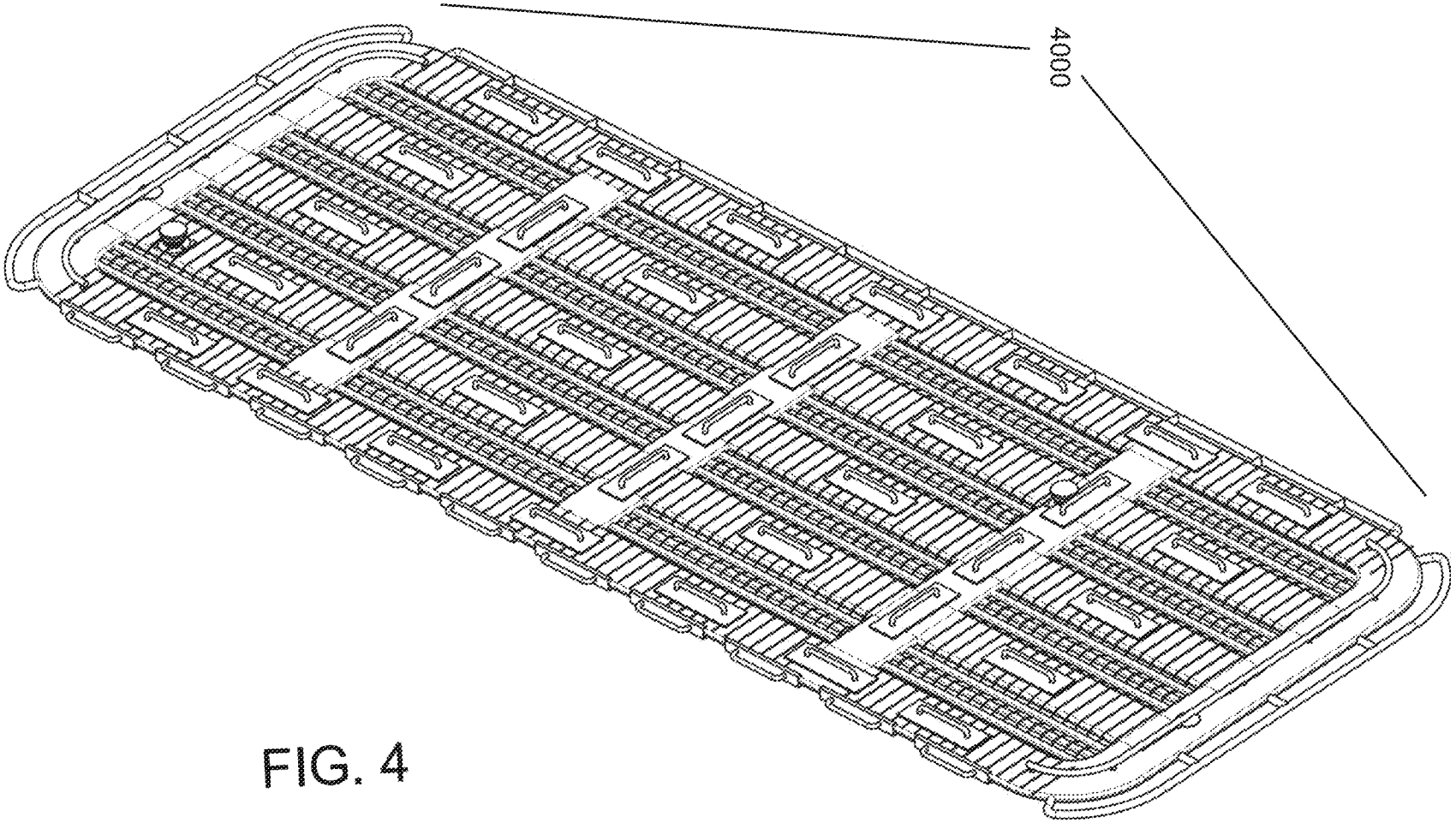
FIG. 4 is a drawing of an uninflated net module, according to an embodiment.

FIG. 4 is a drawing of an uninflated net module, according to an embodiment.

When air is removed from the inflated module 3000, it results in the deflated module 4000. Having less buoyancy, the deflated module 4000 will naturally sink back down to the bottom of the pool.

Figure 5:
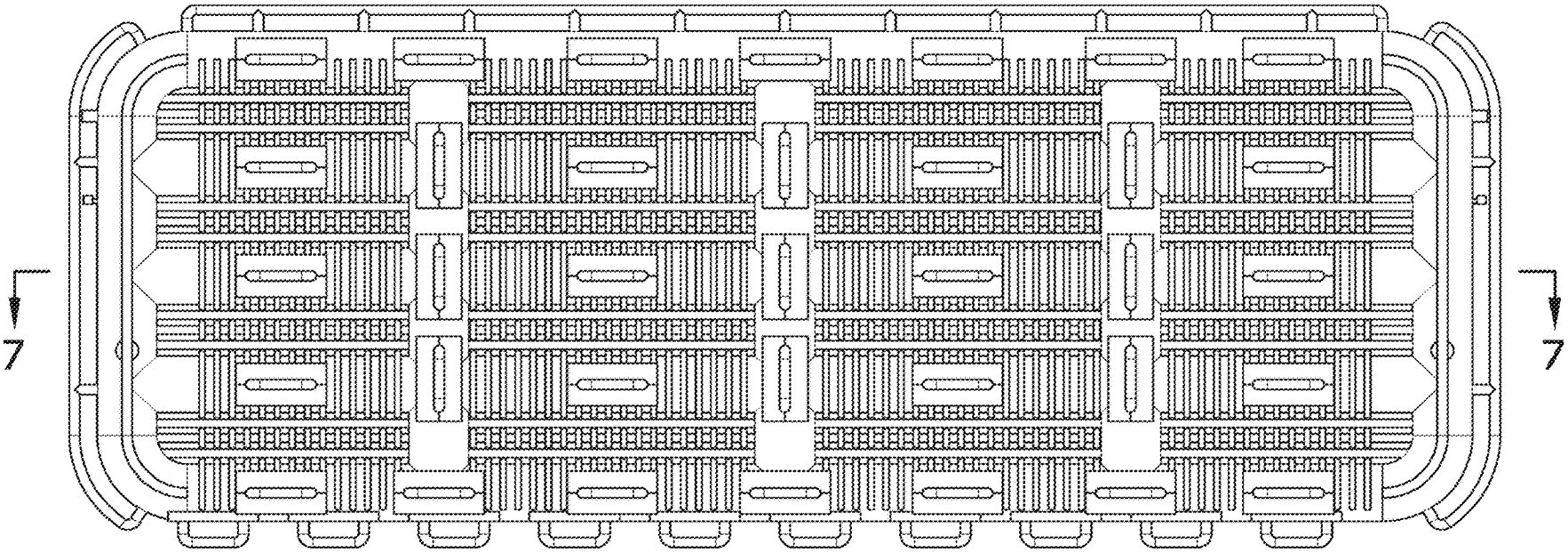
FIG. 5 is a drawing of a top of a net module, according to an embodiment.

FIG. 5 is a drawing of a top of a net module, according to an embodiment. Numerous handles are shown which are built into the module, providing a handle for a distressed swimmer to grab onto.

Figure 6:
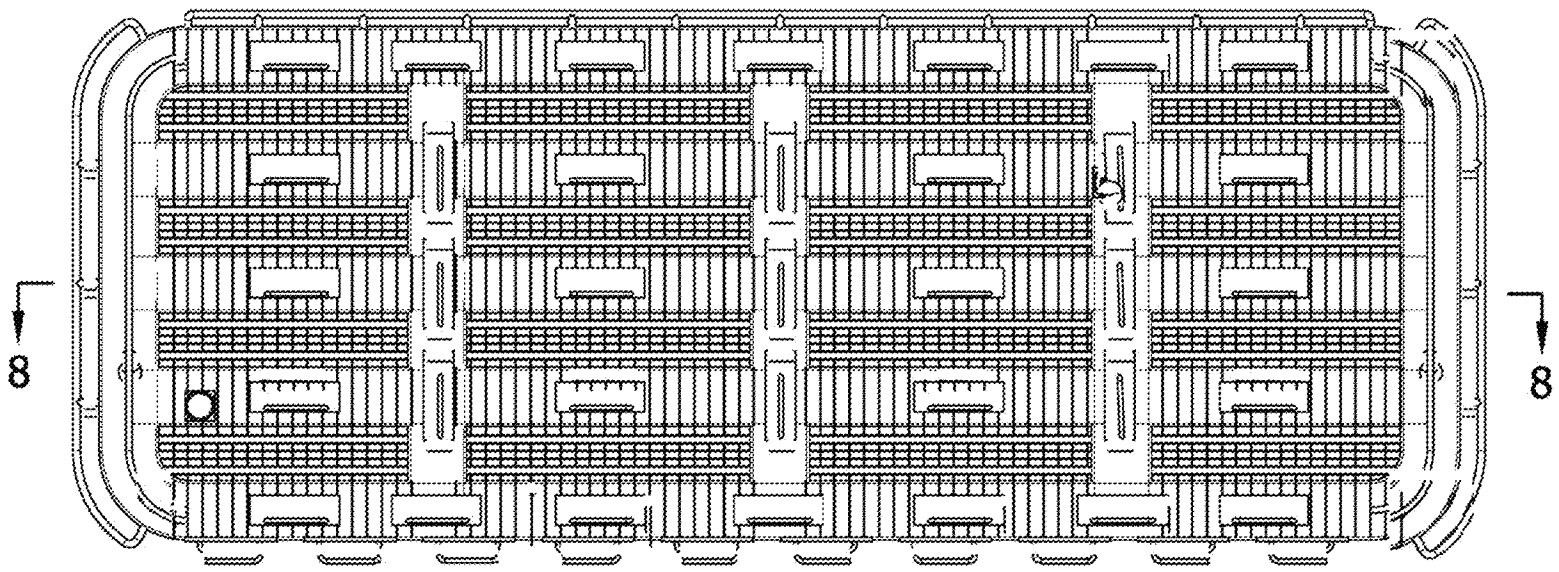
FIG. 6 is a drawing of an uninflated module, according to an embodiment.
Figure 7:
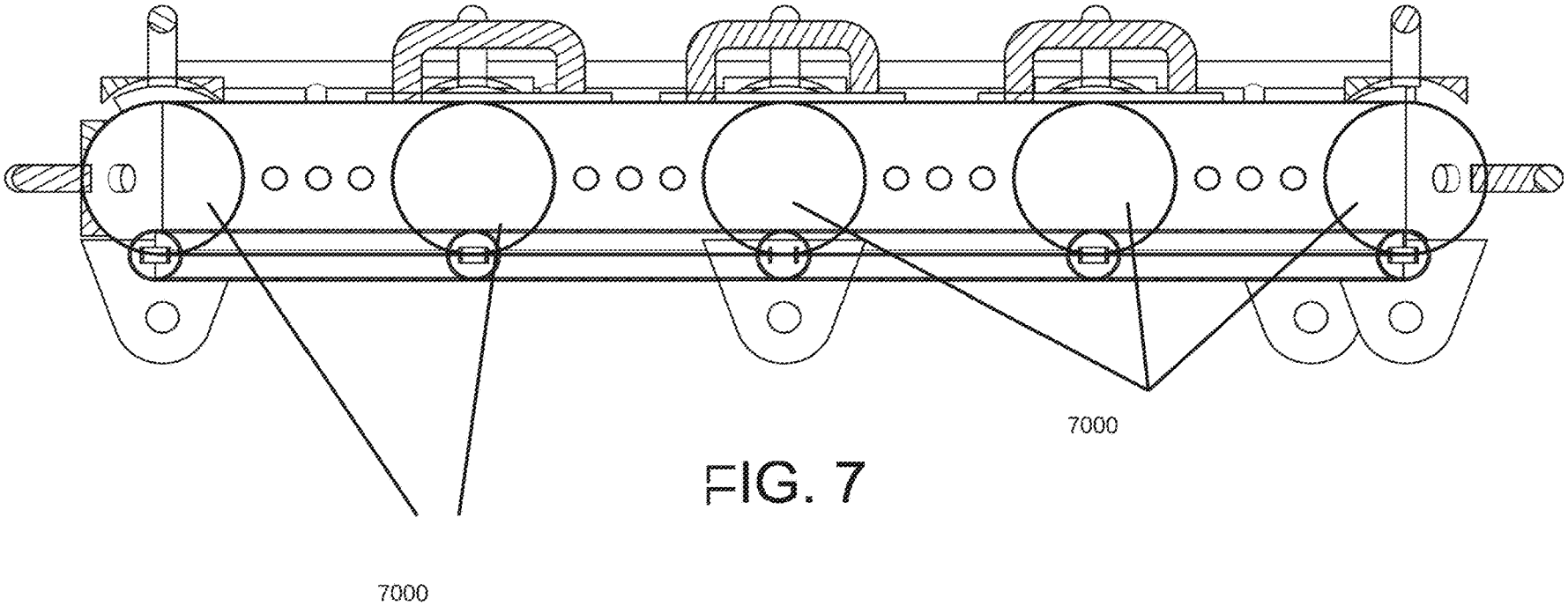
FIG. 7 is a drawing of a cross section of a net module from the view shown in FIG. 5, according to an embodiment.

FIG. 6 is a drawing of an uninflated module, according to an embodiment;

FIG. 7 is a drawing of a cross section of a net module from the view shown in FIG. 5, according to an embodiment.

A plurality of tubes 7000 stretch along a length of the module and are filled with air. In one embodiment, the plurality of tubes 7000 can all be linked internally, as such, when air is introduced to one of the tubes then the air would naturally flow into all of the tubes. In another embodiment, the plurality of tubes 7000 can be compartmentalized, so that different ports would be used to fill (and deflate) air so that if a leak occurred in one compartment, the other compartment would still be airtight and cause the module to rise when that compartment (without the leak) is inflated.

Figure 8:
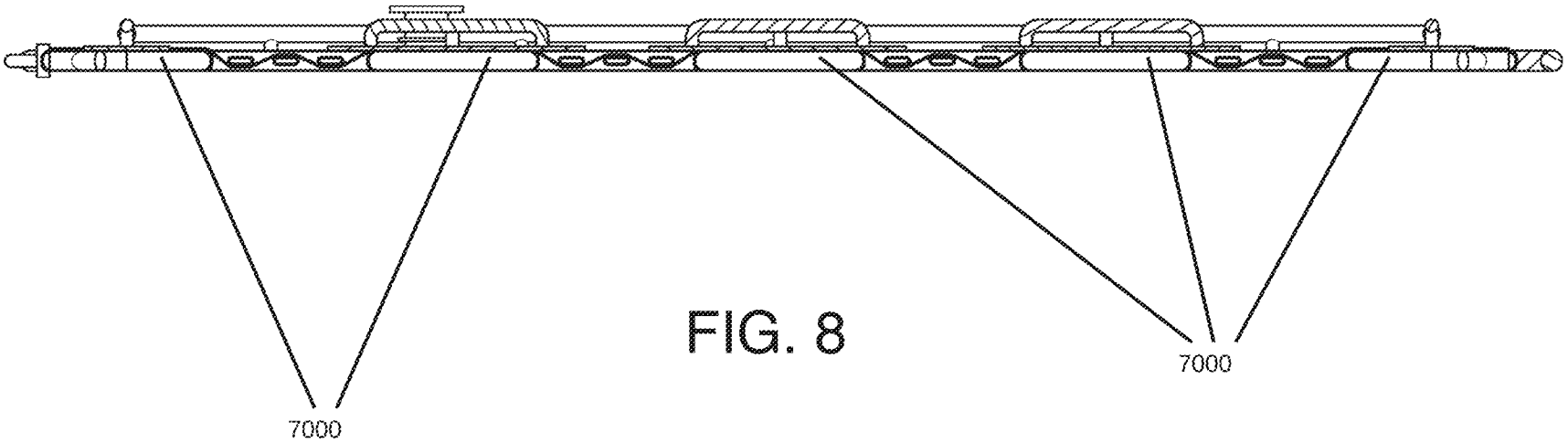
FIG. 8 is drawing of a cross section of a net module, from the view shown in FIG. 6, according to an embodiment.

FIG. 8 is drawing of a cross section of a net module, from the view shown in FIG. 6, according to an embodiment.

In the deflated state, the tubes 7000 in the deflated module 4000 fall flat as they have little or no air left inside them.

Figure 9:
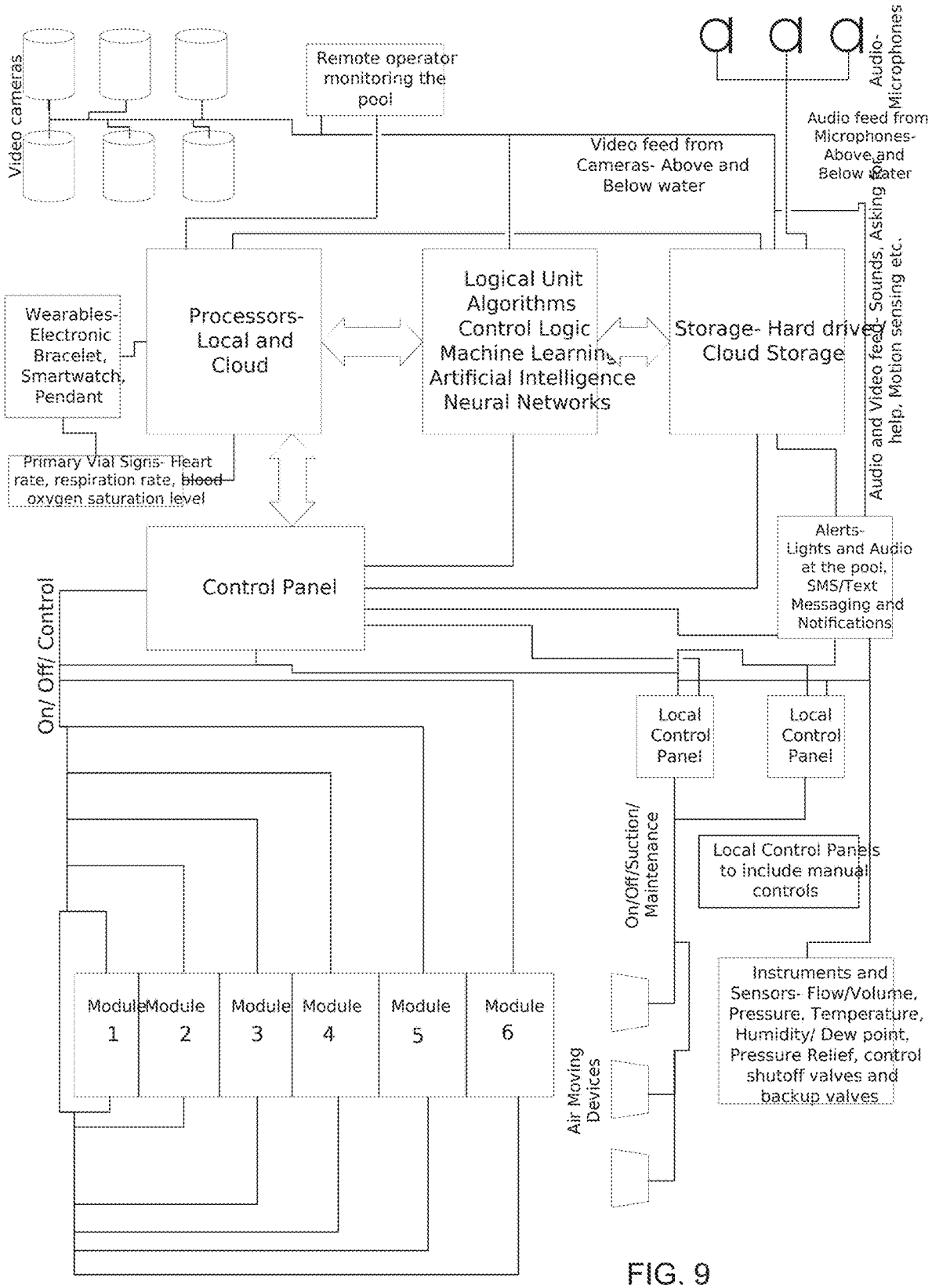
FIG. 9 is a block diagram of a control system architecture, according to an embodiment.

FIG. 9 is a block diagram of a control system architecture, according to an embodiment.

Video cameras and microphones are located above and below water and capture live audio and live video of what is happening in the pool. A processor (both local and cloud processors) can receive, process, store, analyze, and retrieve the live audio and live video feeds. In addition, wearables (such as electronic bracelets, smartwatches, pendants, etc.) can determine information about the wearer such as heart rate, respiration rate, blood-oxygen saturation level, etc. This data can all be transmitted to the processors so the wearer's data can be monitored. If any of the wearer's data is abnormal (e.g., heart rate too high or low, etc.) then an alarm can be triggered and the inflatable net that the wearer is over can be inflated. When an alarm is triggered, lights and audible alarms can be triggered (e.g. bells, sirens, etc.) to alert everyone at the pool that there is an emergency situation. All of the live audio and video data can be stored on a non-transitory storage medium (either on a hard drive, cloud storage, or other type of storage medium).

A control panel allows the operator to inflate individual inflatable net(s). The operator can simply press a button (virtual or real) indicating which inflatable net to inflate, and the system would automatically perform all of the tasks required in order to inflate that net (e.g., open the respective valves, etc.) The operator can also deflate any inflated net by pressing a button (real or virtual) as well. The inflation/deflation can be controlled at control panels located on a control box located at the pool and/or a virtual control panel running on a portable computing device (such as on a cell phone). The control panel (both physical and/or virtual) can also monitor and display all of the readouts from all of the sensors present throughout the system (e.g., flow/volume, pressure, temperature, humidity, dew point, pressure relief, control shutoff valves, backup valves, etc.) The control panel would be connected (physically or wirelessly) to the processing unit so that the operator can interface with the processing unit and interact accordingly (e.g., issue commands to raise and/or lower modules, view status of modules, etc.)

Figure 10:
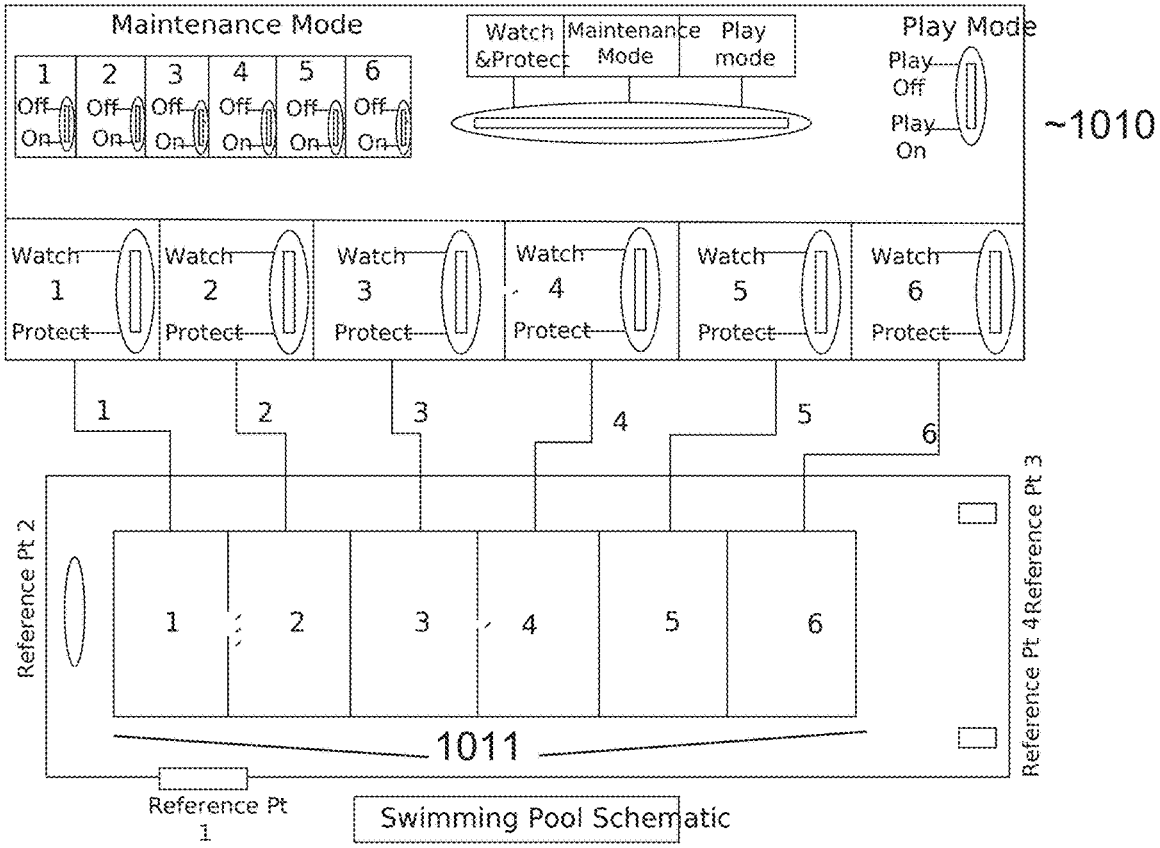
FIG. 10 is a block diagram of a schematic for a safety system, according to an embodiment.
Figure 10:
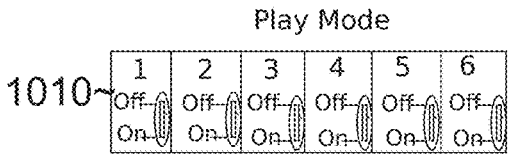

FIG. 10 is a block diagram of a schematic for a safety system, according to an embodiment. FIG. 10 also shows an interface for the control panel 1010 (physical or virtual) that an operator can utilize in order to control the system. The control panel 1010 controls the physical modules 1011.

The operator can manually put each module (numbered 1 to 6 in FIG. 10) in the watch or protect by pressing the respective button. The operator can also select the respective mode (watch and protect, maintenance, play) mode by sliding a lever (virtual or physical) to the desired mode. The operator can also turn on and off the maintenance mode for each individual module via the processing unit. The maintenance mode enables the operator to individually raise and lower each of the modules without triggering an alarm, but in the maintenance mode no module will be in the watch or protect mode, in other words in the maintenance mode all modules are offline and not available to rescue. The operator can also turn on and off the play mode for each of the individual modules. The play mode can enable the operator to selectively raise and lower individual module(s), yet the other module(s) can still remain online so that even if for example, module 1 is put into the play mode (and raised) the other modules in the pool would still be able to be in the watch or protect mode and can be live to rescue distressed swimmer(s) if needed.

There are a number of modes that the system can be in while the system is operational. One mode is the watch mode. In the watch mode (when there is no active drowning incident or potential drowning incident occurring in the pool), the inflatable net is not inflated (deflated). The inflatable net is closer to or on the floor of the swimming pool. This is the case when there is no incident of drowning occurring in the pool at that point of time. In this state, the inflatable net will not be an inconvenience or be an obstacle to the swimmer or to the people in pool because the inflatable net is not in the way for them. The inflatable net will not be an obstacle or hindrance for people and pets who are in the pool at the surface level, people and pets swimming at the surface level, people swimming under water and people diving into the pool at the designated diving areas.

In the watch mode, the inflatable net is ready to be inflated when the system is triggered due to an actual drowning incident or a potential drowning incident. In this mode, all of the available options (as listed under the control system) to activate/trigger the inflatable net and air moving devices are in fully functioning mode.

Another mode the system can enter is the protect mode. This is the mode where there is an actual drowning incident or a potential drowning incident, the control system seamlessly transitions from watch mode to protect mode. Due to the modular design of the inflatable net, the modules/sections/zones of the inflatable net located in the part of the swimming pool where the drowning incident is detected, will be inflated. The remaining modules/sections/zones of the inflatable net that are not activated/inflated will continue to be in watch mode (and will remain deflated at the bottom of the pool). Thus, selected module(s) can be activated (inflated) to rise to the top of the pool while other module(s) can remain inactive (deflated) and remain at the bottom of the pool.

Immediately upon the activation/triggering of the inflatable net, the pressurized air is immediately rushed from the air tank(s) into the activated inflatable net through a network of piping, valves and other humidity, pressure, flow/volume and temperature sensing instrumentation. The inflatable net will rise to the water surface lifting any people or pets in danger of drowning. The air pressure, volume, flow rate, temperature and humidity is monitored to ensure the required buoyancy is achieved to safely raise the humans and pets out of water. In parallel, the system will monitor pressure, volume, flow rate, temperature and humidity to ensure there is no over pressurization that will lead to rupture of the inflatable net. Depending on the location of the actual drowning incident or potential drowning incident and the number of people to be rescued, two or more modules/zones/sections of the inflatable net could be inflated around the same time to save the people and pets. In an embodiment, each inflatable net would fill up with air (from being deflated) in less than 10 seconds, and each inflatable net would float from the bottom of the pool to the surface in less than 30 seconds.

In the protect mode, the spring like component, chains and or the elastic band, the air chambers and the ability to modulate air pressure will provide additional stability in the required directions to the inflatable net because of the expected unbalanced load (location and of people and pets on inflatable net). Thus, the inflated net should rise straight up and not float off to one side.

Another mode is the play mode. In the play mode, a particular inflatable net can be inflated (and hence raised to the pool surface) but no alarms would be triggered. In this way, if people in the pool want to lie on the inflatable nets for sunbathing purposes, then the play mode can be activated for one or more inflatable nets (modules). Another use of the play mode is that a surfaced inflatable net can be used to serve drinks or food.

FIG. 10 shows a control panel, which can be physical (using physical buttons and levers, etc.) or virtual (can be depicted on a touch screen and the operator can interact with it by touching buttons). On the control panel is a plurality of numbered buttons, each representing a respective module (also referred to as inflatable net). If the operator sees a distressed swimmer in a particular area, the operator can push the button corresponding to the area the swimmer is in to immediately raise that respective module.

From an aesthetic point of view, the inflatable net is designed and manufactured in different colors to either match the color of the pool floor to make it less noticeable/visible or to accentuate the swimming pool floor design by making it more visible.

The inflatable net can be installed in a pool of any shape (rectangular, square, curved etc.) and size because the inflatable net can be manufactured in different sizes and shapes (such as but not limited to rectangular, square, circular, elliptical etc.) to suit the specific requirements of the pool. Depending on the size of the pool, the number of modules/ zones of the inflatable net will be installed per the pool owner's requirements. The inflatable net can be installed in above and below ground pools. The inflatable net can be installed in a swimming pool made of concrete, vinyl, liner, fiberglass or any material. The inflatable net can be installed in either fresh water or saltwater pools. The inflatable net can be installed in private/residential, vacation homes, commercial establishments (such as hotels, professional clubs, resorts, training facilities), educational institutions (schools, colleges, universities), medical facilities (nursing homes, hospitals etc.) and other community owned pools.

Each module/zone/section of the inflatable net consists of several ports and valves to enable rapid inflation in case of a drowning incident. The ports and valves to deflate the inflatable net could be the same as those used for inflation or could be a different set of ports and valves. The modules of the inflatable net could contain one or more pressure measuring and transmitting instruments to monitor the pressure of the inflatable net in the protect mode. Alternatively, the pressure measuring and transmitting instruments could be located in the piping that connects the air moving devices to the inflatable net. The piping network includes instrumentation to measure and monitor air humidity, volume, pressure and temperature.

The air moving devices (blowers, air tanks, compressors, valves, etc.) and the instrumentation required for the inflatable net are controlled through a single or multiple control boxes installed at the specific location.

The control box can have manually operated switches/levers is to allow any responsible individual who notices a drowning incident or a potential drowning incident to quickly react and trigger the inflatable net without having to jump into the pool themselves. The manually operated switches/levers would also help any lifeguards located at the pool to quickly rescue the person or pet without having to jump into the pool. In addition, if the person to be rescued is heavier/bigger than the lifeguard or person who could be standing near the pool witnessing the drowning incident or potential drowning incident, the inflatable net will be a great resource and tool to rescue people.

The inflatable net and the air moving devices are activated/triggered due to a potential drowning incident or an actual drowning incident by any of the following options: manual activation switches/levers located near the pool; cameras and microphones located above and below the water level in and around the pool; Control system that receives and evaluates live video and audio feed from cameras and microphones continuously to determine whether a human or pet is either drowning or in danger of drowning using algorithms, control logic, artificial intelligence, neural networks and machine learning techniques; an electronic bracelet/smart watch/wearable worn by the swimmer; an operator remotely monitoring the pool; by monitoring the swimmer's primary vital signs such as heart rate (pulse), respiration rate and blood oxygen saturation levels.

For example, an electronic smart watch, bracelet, or other wearable, which is worn by the swimmer, can communicate wirelessly with the control box/computer, and upon any vital sign being abnormal (e.g., heart rate above a threshold or below a threshold) would trigger the respective module(s) to inflate. The control system could estimate the distance of the swimmer from the sensor to trigger to the exact module or modules with the aid of audio and video. If the system cannot determine which module (inflatable net) is below the distressed swimmer, then the system can raise all modules in the pool.

Note that in addition (or in the alternative) to the controls at the control box, the system can be entirely controlled via an app on a smartphone, tablet, etc., which is in wireless communication with the processing unit 1400. The app can display a graphical user interface (GUI) which enables the user to activate any module or initiate any mode the operator wants to.

Figure 11:
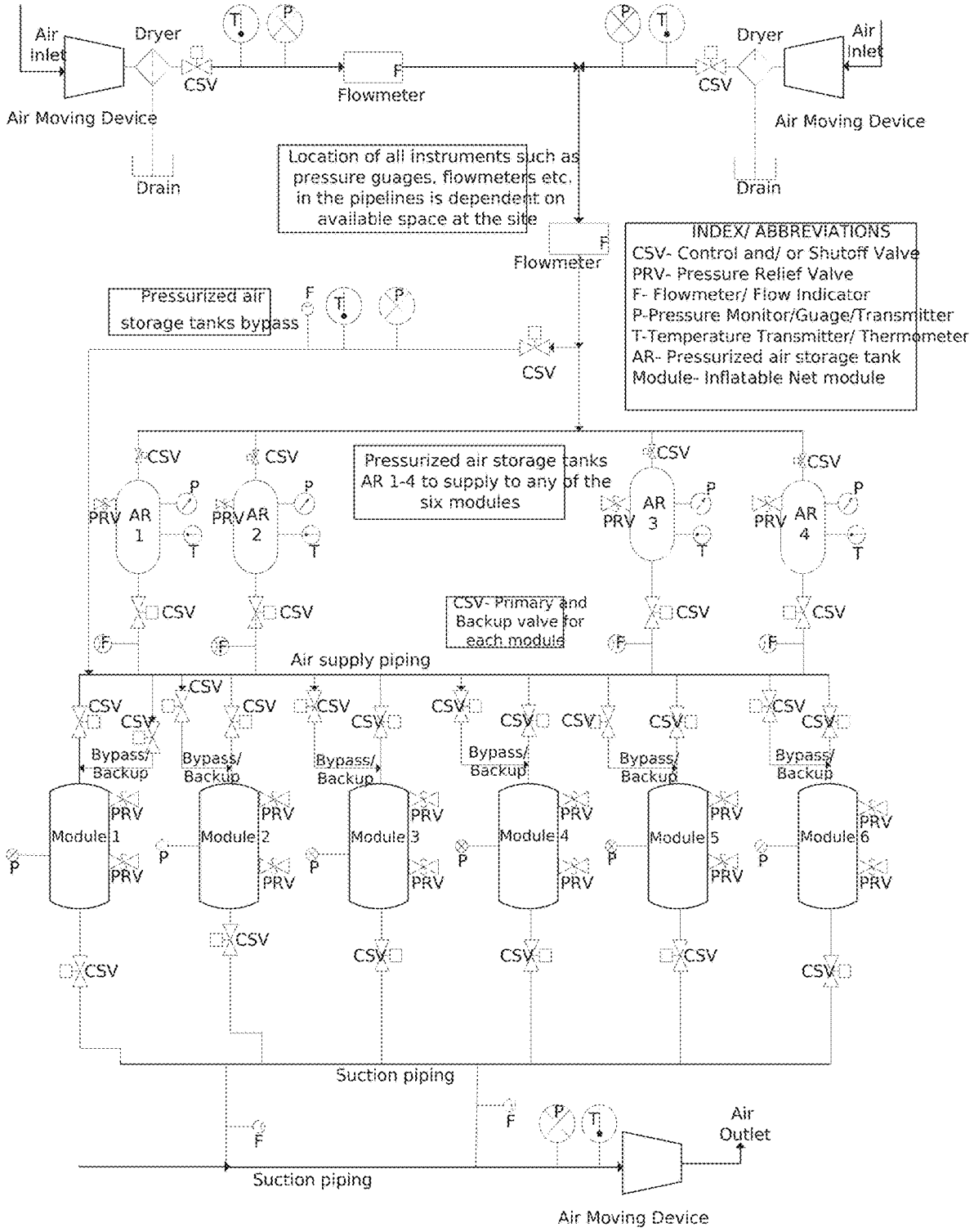
FIG. 11 is a block diagram of the components for a safety system, according to an embodiment.

FIG. 11 is a block diagram of the components for a safety system, according to an embodiment. Note that in this example there are six inflatable nets (modules), four air tanks, two compressors, and one blower, but this is merely one example and it can be appreciated that there can be different numbers of compressors, blowers, inflatable nets, etc.

The piping connecting the compressors and the air storage tanks (air tanks) is the compressor conduit. The piping connecting the air tanks and the inflatable nets is the air supply piping. The piping connecting the inflatable nets and the blower or fan and air outlet is the suction piping, enabling the air to be sucked out of an inflatable net and sucked out the air outlet (into the air).

Various control/shutoff valves (labeled CSV) are present through the system and selectively block an air path. All valves are electronically controlled by the processing unit 1400 so that the appropriate valves can be turned on and off to channel the air to the proper place (either inflating an inflatable net or deflating an inflatable net). The processing unit 1400 stores a virtual map of all of the valves, modules, air storage tanks, compressors, fans/blowers, all piping, all sensors, and all other components. The processing unit 1400 can address and interact individually with any and all of the components at the same site (of course, different sites at different locations would not be able to access each other's systems). Each individual component (e.g., valve, sensor, etc.) can have its own computer with a processor and can be connected to the internet via any known protocol, such as internet of things, etc.

Each air tank can have a pressure relief valve (labeled PRV) to determine the air pressure of each air tank (which is transmitted to the processing unit 1400). If there is an abnormal pressure, the respective air tank can not be used and alternative air tanks can be used to fill each inflatable net. A pressure relief valve can automatically open if the pressure reading is greater than a predetermined setting, thereby avoiding any excess pressure in the air tank which can cause adverse effects. Each air tank has an optional pressure sensor and temperature sensor, of which the readings therein can be transmitted to the processing unit for monitoring. Abnormal values can trigger a shutdown of the particular air tank and an alert sent to the operator. As can be seen in FIG. 11, there are four air tanks and all four air tanks are connected to each of the six inflatable nets. This means that any of the air tanks can be used to inflate any of the inflatable nets.

In FIG. 11, the temperature transmitters (labeled as "T") can detect and transmit (to the processing unit 1400) the temperature so that abnormal temperature can be detected and appropriate action can be taken (e.g., if a temperature is too high, the system can be shut down). The pressure monitors (labeled as "P") detect pressure in the pipes and air pressure tank, and the pressures are transmitted to the processing unit 1400. Abnormal pressures (e.g., too high) can be monitored and dealt with accordingly, for example if a pressure is too high the system can be shut down. Pressure relief valves (PRV) monitor the pressure in the air storage tanks and if the pressure is too high, the pressure relief valves can automatically discharge some air in order to reduce the pressure. CSV control and/or shut valves can be controlled by the processing unit 1400 and can individually be opened and closed in order to direct the flow of air through the desired piping. For example, to inflate a particular module, the appropriate CSVs would be opened (while the remaining CSVs would be closed) so that a path from the respective pressurized air storage tank would be formed, and then the respective pressurized air storage tank would be activated in order to direct the air through the supply piing and into the respective module which would then cause that module to inflate. The processing unit would wait a delay time (e.g., 30 seconds or other time) until the module is fully inflated, and then the CSVs can be closed in order to stop the inflation process. The deflation process can work similarly, wherein the processing unit 1400 would open the respective CSVs while leaving the remaining CSVs closed in order to create a path for the air to exit the respective module through the suction piping and out the exhaust. In an embodiment, a complex network of suction and supply piping can be maintained so that while one module is inflating, another module can be simultaneously deflated.

A data structure can be maintained which maps out each CSV (as well as all sensors, gauges, etc.) into nodes and their connections (e.g., a virtual map). The proper CSVs to open and close can be determined in a number of ways: 1) a virtual table can be maintained which pre-stores which CSVs to open and close based on which module is to be inflated; or 2) a smart algorithm can be run which would determine (using logic, artificial intelligence, algebra, or other method) which CSVs should be opened and close in order to inflate and/or deflate the desired module.

Modules can have more than one pressure relief valve and also more than one control valve. One or more control valves can be used to inflate each module, and one or more control valves can be used to deflate each module. In the example shown in FIG. 11, each module has two control valves (one main, one bypass/backup valve) connected to the air supply piping. This is in case one of the control valves fails, there is a backup control valve to ensure that the module gets inflated. Each module has only one control valve connected to the suction piping to deflate the module. If the module is already inflated, it may be less critical to deflate the module, which is why this example only uses one control valve for deflation.

Note that each inflatable net in FIG. 11 has two pressure relief valves so that if the pressure inside any of the inflatable nets is greater than a predetermined setting, the pressure relief valve can automatically open to release air from inside the inflatable net so that there is not excess pressure inside the inflatable net (excess pressure which could possibly cause the inflatable net to burst).

Note that through the system there are pressure sensors, temperature sensors, and flow meters (sensors) to detect conditions throughout the system. The readings from all these sensors can be transmitted and received by the processing unit, which will take particular action based on abnormal readings. For example, if the temperature (from a temperature sensor) falls outside of a normal range, or the pressure (from a pressure sensor) falls outside of a normal range, or the flow rate (from a flow meter) falls outside a normal range, then an alarm could be triggered and the system can shut down.

Figure 12:
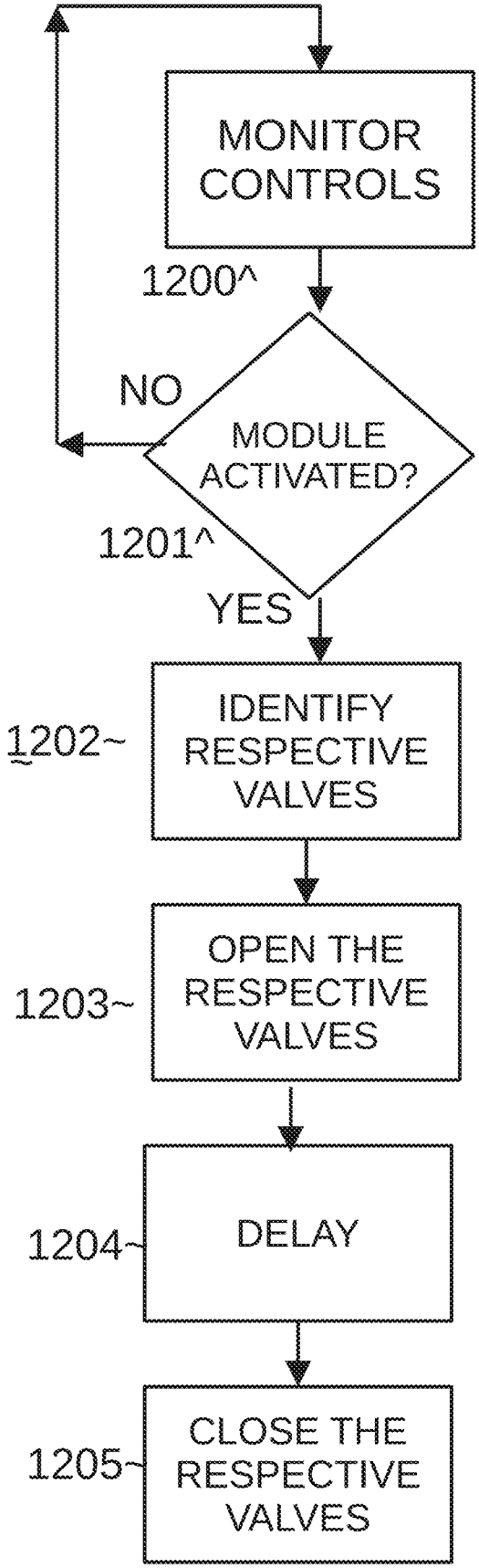
FIG. 12 is a flowchart illustrating an exemplary method of manually implementing a safety system, according to an embodiment.

FIG. 12 is a flowchart illustrating an exemplary method of manually implementing a safety system, according to an embodiment. The system can be operated by an operator, such as a lifeguard or someone who is trained to utilize the system. When a swimmer is in distress (e.g., drowning or otherwise needs rescue), the operator can access the control box and operate a switch/button to raise the particular module under the distressed swimmer. Note that if a swimmer is between two modules, then both of those modules under the distressed swimmer can be raised simultaneously. The method illustrated in FIGS. 12-13 can be implemented by the control unit 1500 (inside the control box) which can comprise the structure illustrated in FIG. 14.

In operation 1200, the system can monitor the controls. From operation 1200, the method proceeds to operation 1201, which determines whether any switch/button has been activated to raise a module. If no switches/buttons are pressed, then the system returns to operation 1200 and continues to monitor the controls. While the system is cycling between operations 1200-1201 with no module activations, this can be considered the "watch mode."

If in operation 1201, it is determined that a module has been activated, the method proceeds to operation 1202. In operation 1202, the system identifies which valves are on the path between the air tank and the module. There can be multiple air tanks for redundancy, and only one needs to be activated at any one time, although in another embodiment multiple air tanks can be activated simultaneously in order to inflate the module more quickly. Air supply piping connect the air tanks to the modules. The valves on the air supply piping that need to be opened are determined (e.g., by using a lookup table or program logic).

From operation 1202, the method proceeds to operation 1203, which opens the respective valves determined in operation 1202. This will cause air to exit the air tank and flow into the respective module. Note that each module can have one valve connecting the module to the air supply piping which would be opened in order to allow air to inflate that module. In an embodiment, each module can also have a bypass/backup valve in case the other valve malfunctions. Note that each air tank would also have a valve to release air from that tank. Thus, in order to fill a module from the air tank, two valves would typically need to be opened, the valve attached (or associated) with the air tank, and the valve at the module, thereby when both are opened, pressurized air can exit the air tank and by virtue of its pressure, would continue to flow through the air supply piping and enter the module that is to be inflated.

From operation 1203, the method proceeds to operation 1204, which delays for a predetermined amount of time. The valves should remain open for a predetermined period of time, for example 10 seconds, which would allow the module to be fully inflated. As the module is inflated, its reduced density would cause it to rise in the pool and would rise to the surface of the pool. In an alternative embodiment, the length of the delay can be based upon air pressure readings. If the air pressure near the inflatable net being inflated is below a predetermined amount, the valve can remain open until the air pressure reaches the predetermined amount (meaning the inflatable net is full), upon which the respective valve can be closed to prevent any further air from entering this inflatable net.

Note that if a flow meter is not sensing what it is predicted to be, for example if an inflatable net is supposed to fill but there is little or no flow through the air supply piping leading to that inflatable net, then it can be assumed there is some sort of malfunction (e.g., a valve is blocked or malfunctioning). Each inflatable net can have a bypass/backup valve connecting the inflatable net with air supply piping and in case of a malfunction of the primary valve, the bypass/backup valve can be opened. If the flow meter registers what would be considered a proper air flow at this point then this implies that the primary valve was malfunctioning. If the flow meter is still registering an abnormal (value out of range while the inflatable net is supposed to be filling) then an alarm can be triggered that there is a malfunction. Whenever a malfunction is detected, an operator's cell phone can be texted or called alerting him/her of this fact.

After the predetermined delay in operation 1204, the method proceeds to operation 1205, which then closes the valves that were opened in operation 1203. The module should now be at the top of the pool (or rising to the top) and should lift the distressed swimmer to the top of the pool along with it.

Note that in operation 1200, the operator can activate more than one module simultaneously, for example, if the swimmer is located on an edge of one module, then activating (raising) both that module and the module adjacent to it would be warranted. The method illustrated in FIG. 12 would be performed for each module indicated to be raised.

In FIG. 12, the modules that are raised are identified at the control box and buttons/switches, etc., are activated by the operator. In another embodiment, the cameras 1004 are automatically monitored using artificial intelligence in order to automatically identify whether a swimmer is in distress. When a swimmer is in distress, the module(s) that the swimmer is in close proximity to would be automatically identified, and those modules would automatically be instructed to be raised, without any human operator being involved.

Figure 13:
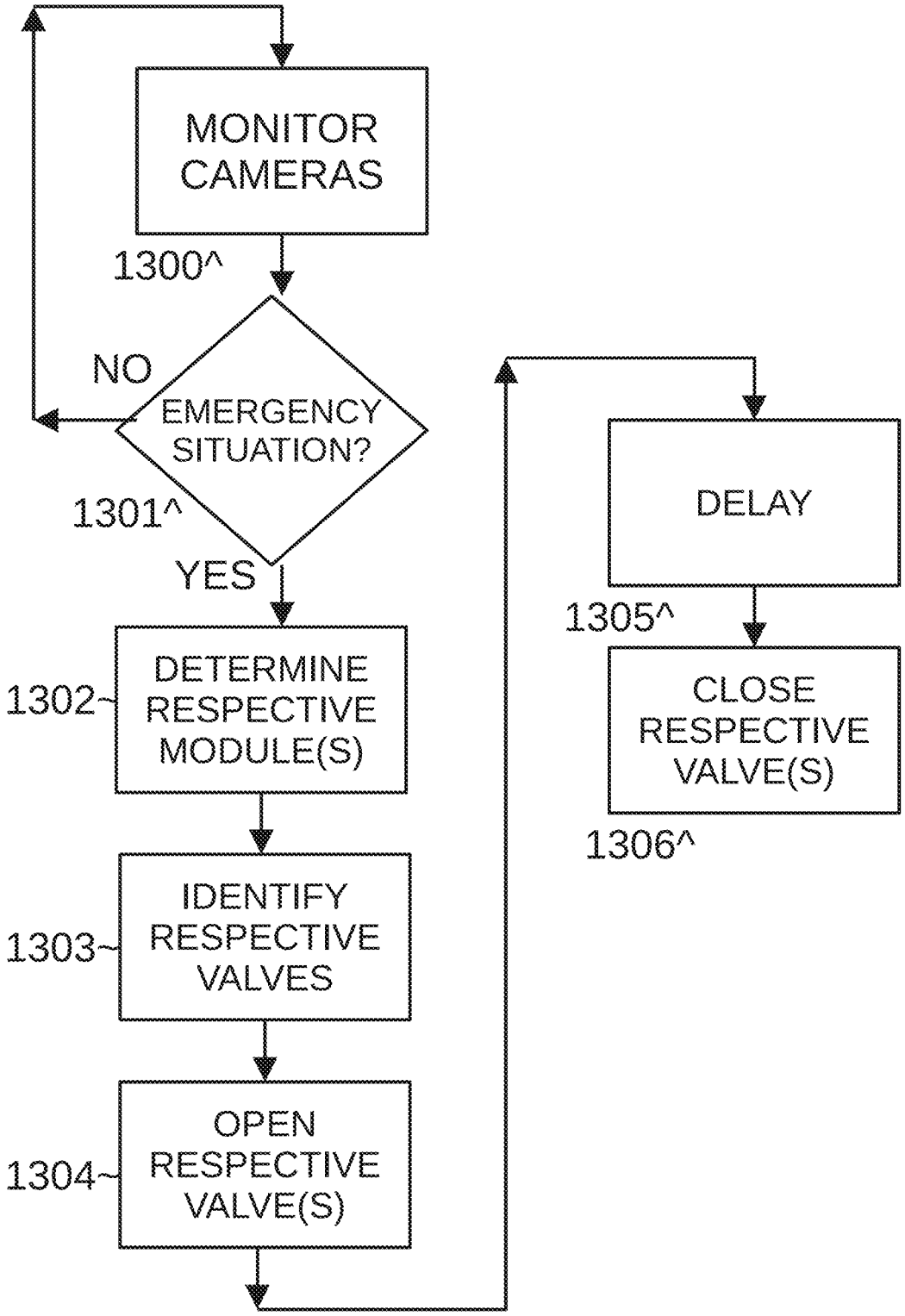
FIG. 13 is a flowchart illustrating an exemplary method of automatically implementing a safety system, according to an embodiment.

FIG. 13 is a flowchart illustrating an exemplary method of automatically implementing a safety system, according to an embodiment. FIG. 13 is similar to the method illustrated in FIG. 12, but instead of a human operator identifying when and which module(s) to raise, the module(s) are automatically identified by the computer system using artificial intelligence.

In operation 1300, the cameras 1004 are automatically monitored. Live video feeds are transmitted (wired or wirelessly) from the cameras 1004 to the processing unit 1400 of the computer.

From operation 1300, the method proceeds to operation 1301 which determines whether there is an emergency situation in the live video. This can performed by, for example, a convolutional neural network that is constantly monitoring the successive frames in the video. The neural network can be trained on videos of subjects drowning or in distress (and being identified as being in distress) as well as videos of subjects not in distress (and being identified as not in distress) so the machine learning system can discern the difference. The convolutional neural network would then be able to recognize segments in the video that are predicated in the distressed swimmer training videos even if the images captured in the videos do not exactly match what is depicted in the training videos. If the neural network determines that there is an emergency situation captured in the live video, or the confidence level of there being an emergency situation is greater than a predetermined threshold, then the method would proceed to operation 1302. If there is no determined emergency situation, then the method would return to operation 1300 to continue monitor the cameras. While the system is cycling between operations 1300-1301 with no module activations, this can be considered the "watch mode."

Note that in addition to video, audio can also be monitored and utilized to determine whether there is an emergency situation. Microphones can be placed around the pool and the neural network (although a neural network is not required) can be listening for audible clues that would be indicative of distress (such as cries for "help"). If the audible clues result in a determination that a swimmer is in distress, then the swimmer that is crying for help can be located by the cameras and the respective inflatable net under that swimmer can be identified so that that respective net can be inflated. If it is not possible to identify the swimmer that is crying for help, then all of the inflatable nets can be raised.

The artificial intelligence system can be trained using a deep learning approach, specifically employing convolutional neural networks (CNNs) trained on a comprehensive dataset of swimming and drowning incidents. The system can be implemented using widely available deep learning frameworks such as TensorFlow or PyTorch, utilizing pre-trained models like ResNet-50 or YOLOv5 as a foundation. The training data should include both normal swimming behavior patterns and examples of drowning events, captured from multiple camera angles and lighting conditions. The CNN architecture may be structured with multiple convolutional layers followed by pooling layers, designed to extract relevant features such as body position, movement patterns, and water disturbance. Common computer vision libraries such as OpenCV can be used for initial video processing and frame extraction, while MediaPipe or OpenPose can assist with human pose estimation to track body positioning.

The training process involves feeding labeled video sequences through the neural network, where drowning and non-drowning examples are clearly marked. The system learns to recognize temporal patterns and spatial features characteristic of drowning events through iterative training using backpropagation. To enhance accuracy, the model can be augmented with additional computer vision techniques such as optical flow analysis to track movement patterns, implemented using OpenCV's built-in functions like calcOpticalFlowFarneback( ). Data annotation can be performed using tools like CVAT or LabelImg to mark drowning incidents in the training data. The model's performance can be improved using transfer learning techniques, starting with weights pre-trained on large-scale human action recognition datasets such as Kinetics-400. The training data can be further enriched using data augmentation techniques such as rotation, scaling, and brightness adjustment through libraries like Albumentations to improve the model's robustness across different environmental conditions and viewing angles.

If in operation 1301, it is determined that there is an emergency situation (or that the confidence of there being an emergency situation is greater than a predetermined threshold) then the method proceeds to operation 1302, which determines the respective module(s) to raise. This can be done by inspecting the videos, and different areas in the videos can be correlated to different module zones (areas of the pool which would be over respective modules). For example certain areas in a frame for each camera would be correlated to a particular module, as a swimmer that is in distress that is located in that particular area of the frame would be over a particular module which is correlated to the particular area of the pool of that frame area where the distressed swimmer is captured. If a distressed swimmer is located in an area which is close to two modules, then both modules can be identified as needing to be raised.

From operation 1302, the method proceeds to operation 1303, which identifies the respective valves which are needed to be opened to allow the compressed air to flow through the air supply piping in order to inflate the module. This can be done as described with regard to operation 1202 from FIG. 12.

From operation 1302, the method proceeds to operation 1304, which opens the valves identified in operation 1303. This can be done as described with regard to operation 1203 from FIG. 12.

From operation 1304, the method proceeds to operation 1305, which delays while the valves are opened so that the module(s) identified to be raised are indeed inflated and raised. This can be done as described with regard to operation 1204 from FIG. 12.

From operation 1305, the method proceeds to operation 1306, which closes the respective valves that were opened in operation 1304. This can be done as described with regard to operation 1205 from FIG. 12.

Note that the method illustrated in FIG. 13 can be implemented entirely automatically, so that artificial intelligence can be utilized to determine to raise a module and to actually raise the module, without human/manual intervention.

Figure 14:
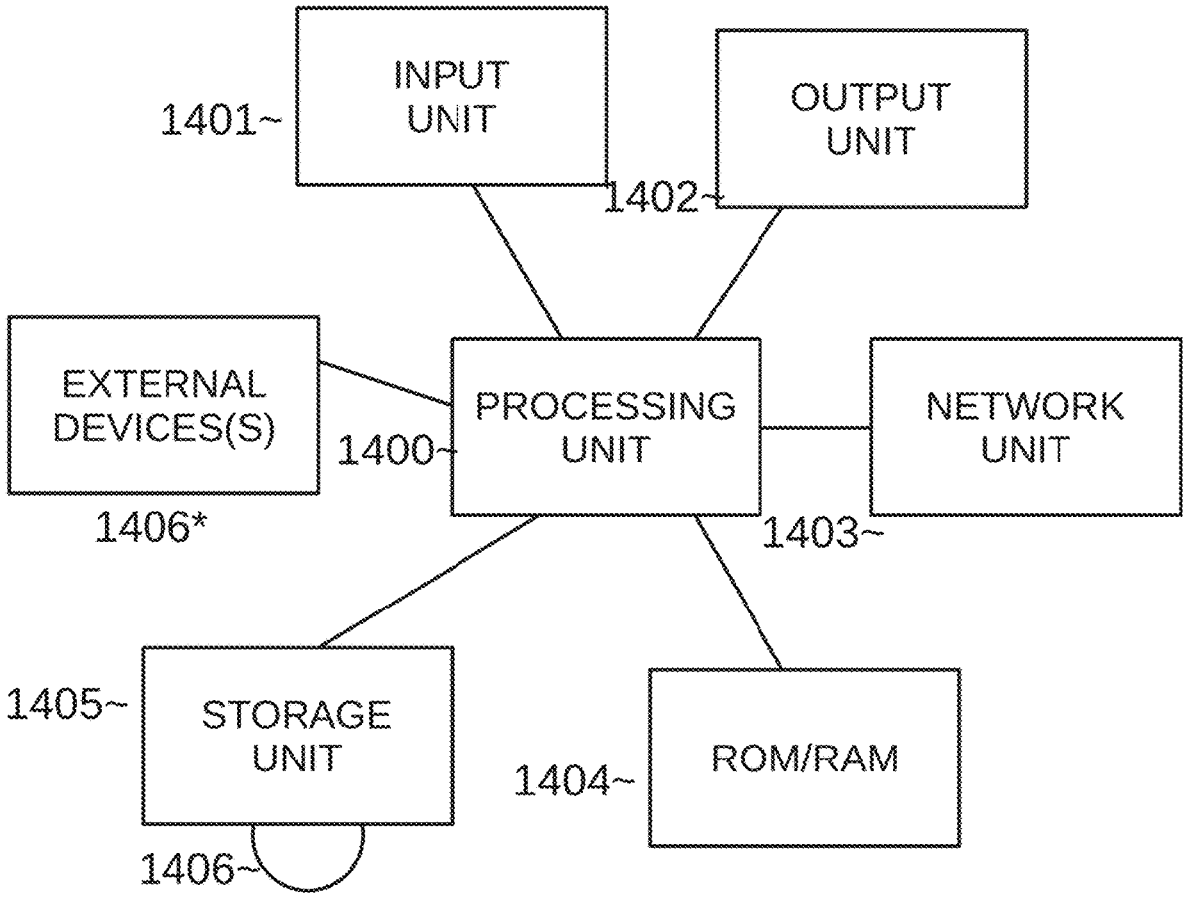
FIG. 14 is a block diagram of hardware to implement a digital computer, according to an embodiment.

FIG. 14 is a block diagram of hardware to implement a digital computer, according to an embodiment. This computer can be used to implement the control unit, any server (in any location), mobile phone, tablet, or anywhere an electronic processor is used or needed.

A processing unit 1400 can be any microprocessor or microcontroller (e.g., ESP32, etc.) and any associated structure (e.g., cache, power supply, voltage regulator, bus, etc.) The processing unit can be connected to one or more input unit(s) 1401 (e.g., keyboard, touch screen, etc.) and one or more output unit(s) (e.g., CRT, LCD, touch screen, speakers, etc.). The processing unit can also be connected to a network unit 1403 which can connect (wired or wirelessly) to other computers and/or networks, such as an ethernet connection, Bluetooth adapter, Bluetooth Low Energy (BLE), Wi-Fi adapter, etc. The processing unit 1400 can also be connected to a ROM 1404 (which can be used for storing programs such as a BIOS, etc.) and RAM 1404 (which can be used to store programs and/or data, assets, or any digital values). The processing unit 1400 can also be connected to a storage unit 1405 which can read and write to a non-transitory computer readable storage medium. For example, the storage unit 1405 can be a CD-ROM drive and the computer readable storage medium can be a compact disc, the storage unit 1405 can be a EEPROM slot and the computer readable storage medium can be an EEPROM, the storage unit 1405 can be a flash memory reader/writer and the computer readable storage medium can be a flash memory chip, etc. Any non-transitory computer readable storage medium 1406 can be used which can be read and written to by a respective storage unit 1405. The non-transitory computer readable storage unit 1406 (and also the ROM/RAM 1404) can store a computer program that comprises computer readable instructions, that when executed, would cause the processing unit 1400 to implement any feature, method, function, etc., described herein. The processing unit 1400 can also be connected to external devices 1406 to control them, such as valves, sensors, blowers, motors, and/or any device described herein. Connection to external devices can be via the network unit 1403 or via a dedicated analog or digital, wired or wireless, one way or bi-directional, signal, between the processing unit 1400 and each of the external device(s) 1406. For example, the processing unit 1400 can be connected to any of the external device(s) via a USB connection, etc. As such, the processing unit 1400 can control any of the external device(s), such as opening and closing valves, starting and stopping motors, viewing cameras, reading sensors, output sounds to a speaker, send notifications etc.

Note that while only one processing unit 1400 is illustrated herein, it can be appreciated that multiple processing units can be utilized, working together, in a same or different physical locations (which can all be in communication with each other via a computer network(s)). Also not pictured are any other hardware that is needed to implement the computer, such as a power supply, etc. Note that whenever the processing unit 1400 issues a command (transmits a signal) to another device in the system, it is assumed that that device receives the command and initiates the commanded action (for example, if a valve is commanded to open then it naturally follows that the valve is configured to receive the command and act accordingly which would be to open).

Figure 15:
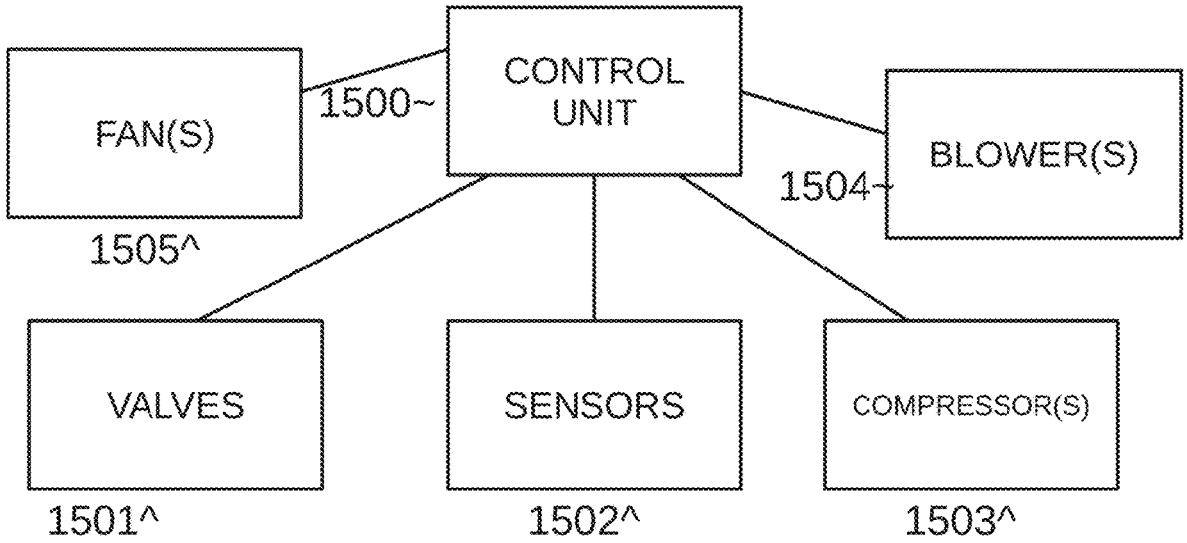
FIG. 15 is a block diagram of components utilized in the system, according to an embodiment.

FIG. 15 is a block diagram of components utilized in the system, according to an embodiment. A control unit 1500 can be located in each control box 1020, and can have the structure illustrated in FIG. 14.

The control unit 1500 can be connected to all of the valves 1501, sensors 1502, and compressor(s) 1503, and blower(s) 1504 and fans 1505. The control unit 1500 can selectively open and close each of the valves 1501. The control unit 1500 can also read the current data from the sensors 1502 (e.g., pressure, temperature, etc.) The data from the sensors would typically be in digital form, although it can also be in analog form and converted to digital. The control unit can also be connected to the compressor(s) 1503 and can turn them on (to fill the air tanks) and off (when the air tanks are full). The control unit can also be connected to the blower(s) or fans 1504 in order to turn the blower(s) or fans on (to deflate a module) and turn it off (when the module is fully deflated).

Figure 16:
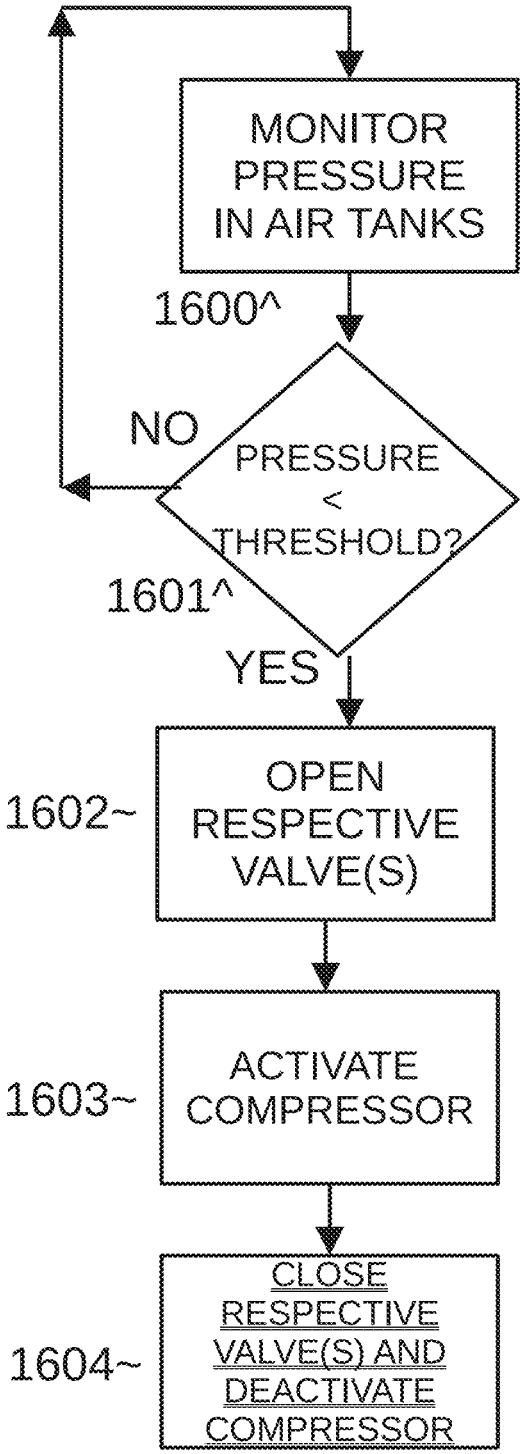
FIG. 16 is a flowchart illustrating an exemplary method to refill air tanks, according to an embodiment.

FIG. 16 is a flowchart illustrating an exemplary method to refill air tanks, according to an embodiment. In order to maintain proper operation of the system, the air tanks should have at least a minimum pressure in order to be able to inflate the module(s) when needed. The operations in FIG. 16 can be performed continuously for each air tank in the system at the pool.

In operation 1600, the control unit 1500 (via the processing unit 1400) monitors the pressure in the air tanks. The pressure in the air tanks can be determined via pressure monitors (pressure sensors) located at the air tanks (also referred to as pressured air tanks). If the pressure is below a certain threshold, this would typically indicate that the air tank is low on compressed air and should be refilled.

From operation 1600, the method proceeds to operation 1601, which determines whether the pressure in an air tank is lower than a predetermined threshold. If not, then the method returns to operation 1600 which continues to monitor the pressure in the air tank.

If in operation 1601, the pressure in the air tank is lower than a predetermined threshold, then the method would proceed to operation 1602. This would signify that the quantity of air in the air tank is low and needs to be filled. In operation 1602, the control unit 1500 opens the valves(s) connecting a compressor to the air tank (the particular air tank that is low on air in operations 1600-1601). Any valve(s) on the path between the compressor 1000 and the air tank on the air compressor conduits would be opened to enable the compressor 1000 to fill the air tank with more compressed air.

From operation 1602, the method proceeds to operation 1603 which activates the respective compressor 1000, which causes the air to flow from the compressor to the respective air tank through the compressor conduits through the valves that were opened in operation 1602. The compressor would be activated for a duration of time until the pressure in the respective air tank is higher than the predetermined threshold from operation 1601. Once the air tank is filled (which can be discerned by monitoring the pressure in the air tank), then the method proceeds to operation 1604.

In operation 1604, the compressor is now deactivated (turned off) and the respective valves that were opened in operation 1602 are now closed. The air tank that was low on air is now filled and can be used to inflate a module when needed.

Figure 17:
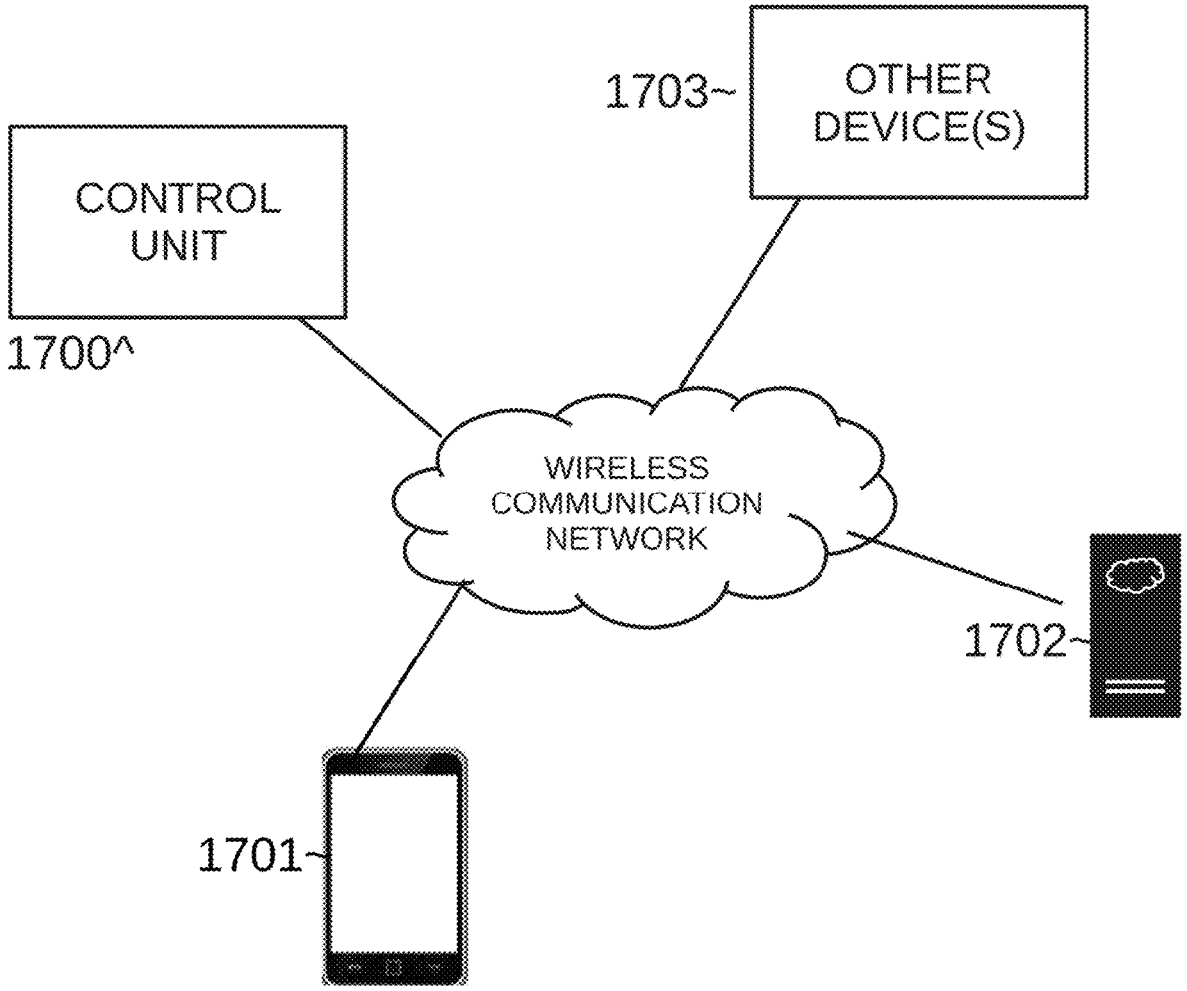
FIG. 17 is a network diagram illustrating participants of the system, according to an embodiment.

FIG. 17 is a network diagram illustrating participants of the system, according to an embodiment. All of the separate computing devices (e.g., servers, cell phones and other portable devices, blowers, compressors, air tanks, valves, control boxes, processing units, wearables, video cameras, microphones, and any other device described herein) can be connected wirelessly to each other in a networked configuration. Communications between all of these devices can be effectuated via any wireless protocol (e.g., Wi-Fi, Bluetooth, Bluetooth Low Energy (BLE), Lora, Zigbee, etc.) Note that all of the devices (including the blowers, compressors, air tanks, valves, etc.) can be controlled via the control unit 1700 (and hence the processing unit 1400) and can be activated, turned on, turned off, monitored, etc. remotely.

The control unit 1700 (or multiple such control units 1700) can be connected to a wireless communication network (including the Internet) via any wireless protocol. A cellular phone 1701 (or other portable computing device such as a notebook computer, tablet, etc.) can also be connected to the wireless communication network and can access the control unit 1700 and enable the user to interact with the system and control it via a GUI displayed on the cellular phone 1701. A server 1702 can also be connected to the system and can store all data relating to the system (e.g., video streams, audio streams, activation history, etc.) Other device(s) 1703 can be any other device described herein, such as a wearable computing device, video camera, microphone, etc., and can also be connected wirelessly to the wireless communications network. All participants, processor(s), components, computers, etc., illustrated (or described herein) can communicate with each other and share any data they may have, whether such communication is done via wire (e.g., ethernet connection, or wireless (e.g., Bluetooth, Bluetooth Low Energy, Wi-Fi, etc.). All communications can be transmitted directly to each other (locally) or using a computer communications network (such as the Internet).

Note that all of the components of the system (e.g., valves, blowers, compressors, air tanks, cameras, microphones, sensors, etc.) are all individually addressable by the processing unit 1400 and can be controlled by the processing unit 1400. The processing unit 1400 can transmit simple digital signals to each of the components in order to instruct them to take certain actions. For example, a digital "1" can be transmitted to a particular valve instructing it to open (upon which it will open upon receiving that signal). and a digital "2" can be transmitted to the particular valve instructing it to close (upon which it will close upon receiving that signal). So in order to inflate a particular net, the valve(s) between the air tank that is connected to the particular net should be instructed to open. In order to deflate a particular net, the valve(s) between the air tank that is connected to the particular net should be instructed to close and the valve(s) that are between the particular net and the blower should be instructed to open and the blower should be instructed to turn on (also by sending the blower a respective signal) which would cause the particular net to deflate by sucking all of the air out of it and routing the air through the suction piping and out into the regular air.

Figure 18:
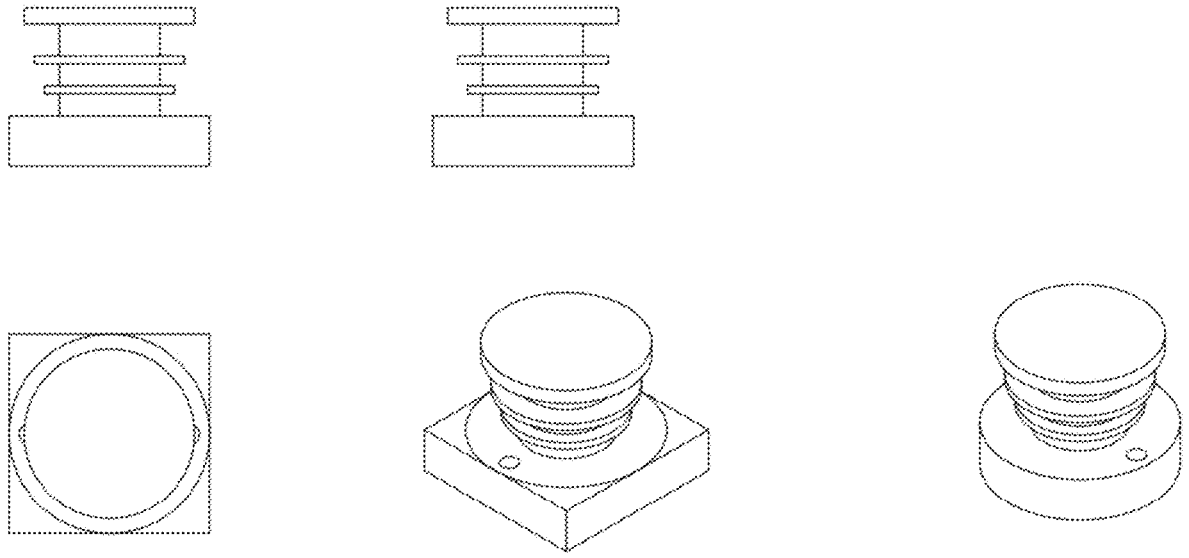
FIG. 18 is a drawing of various anchors, according to an embodiment.

FIG. 18 is a drawing of various anchors, according to an embodiment.

The anchors can be connected to the pool via adhesive, screws, mechanical connections, or any other connection mechanism. The anchors can be connected to a chain, elastic band, bungee, etc. (which is then attached to a module) via a hole that the chain, elastic band, bungee, etc. can fit through, or the chain, elastic band, bungee, etc. can be wrapped around (or tied to) the anchor.

Figure 19:
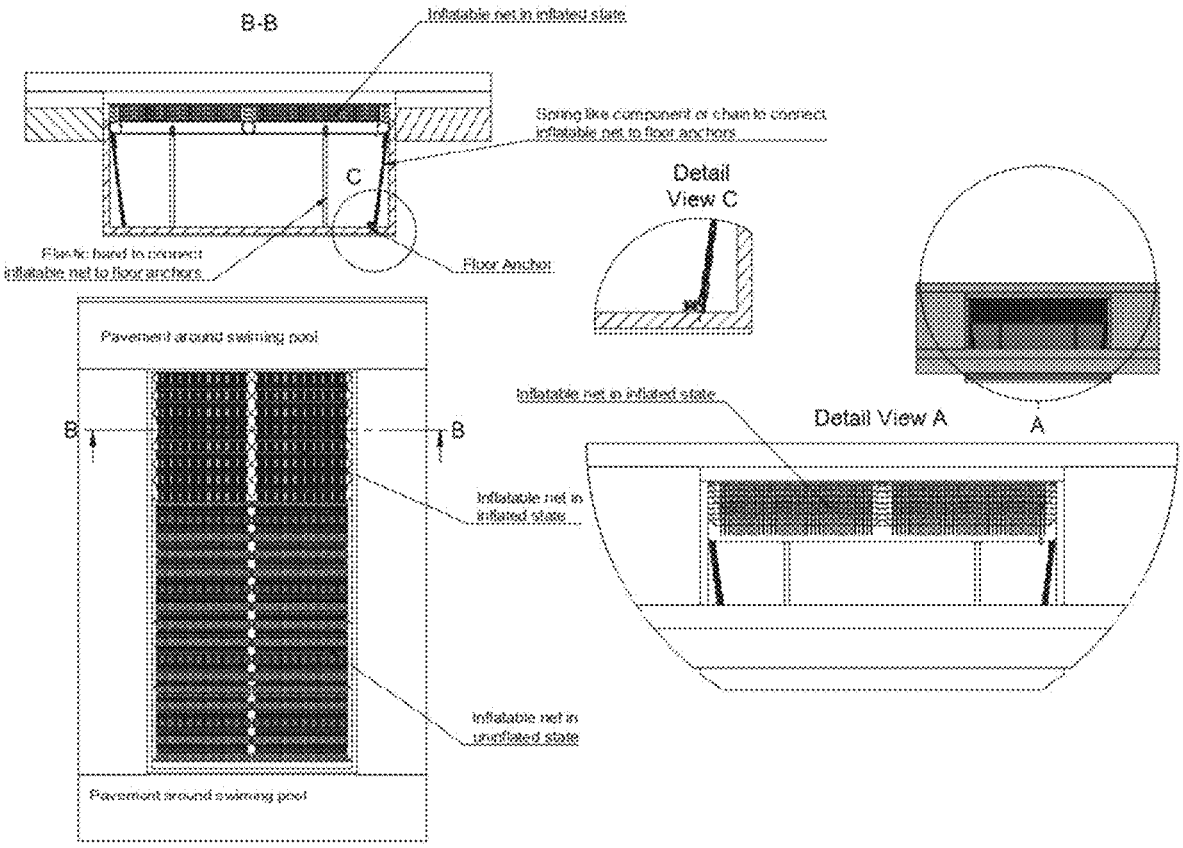
FIG. 19 is a drawing of how anchors can connect to an inflatable net, according to an embodiment.

FIG. 19 is a drawing of how anchors can connect to an inflatable net, according to an embodiment. The attachment to the module(s), such as the chain, bungee, cord, elastic band, etc., can be tied or clipped (e.g., using a carabiner clip clipped onto a hook on the module) to its respective module.

Figure 20:
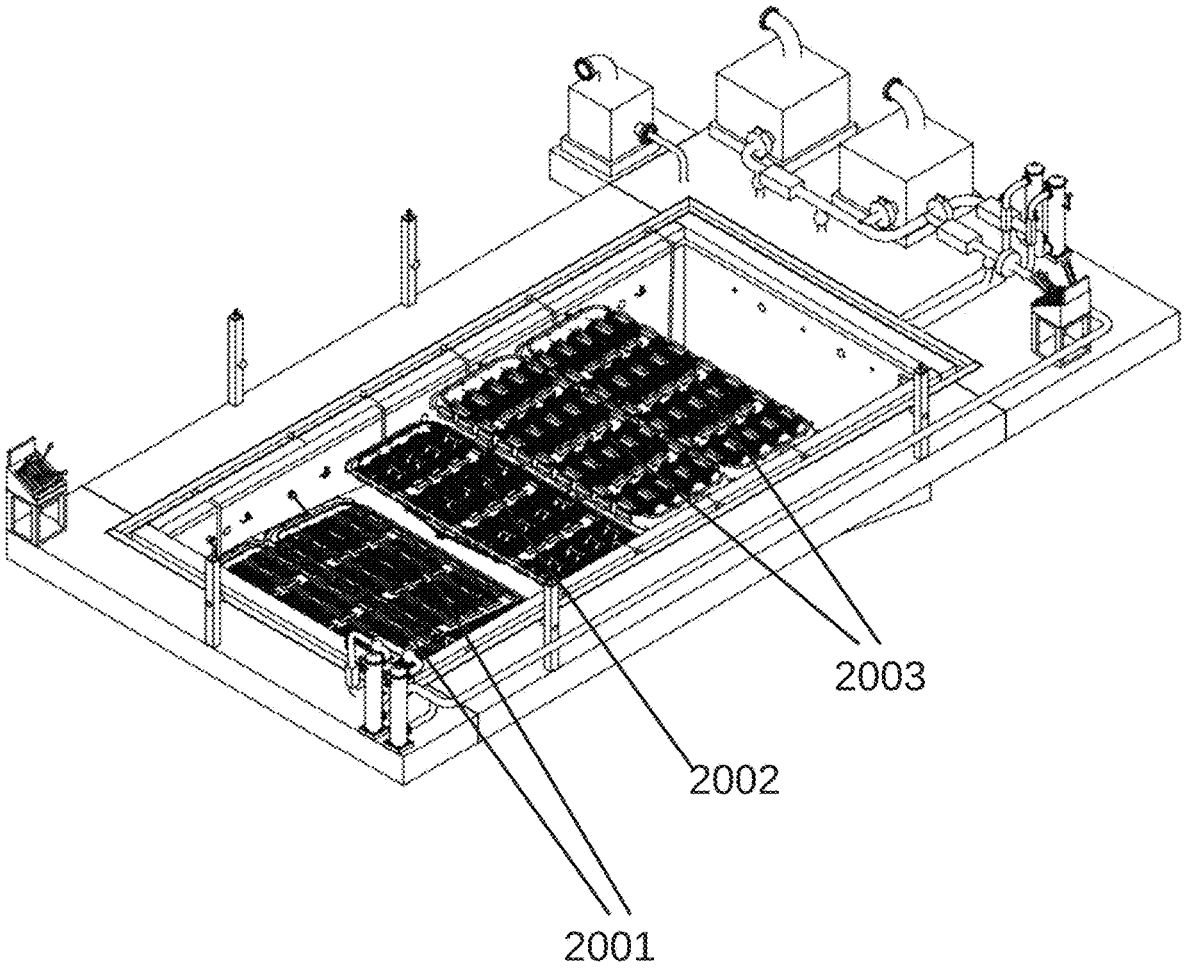
FIG. 20 is a drawing showing a pool with two modules fully inflated, one module semi inflated, and three modules not inflated, according to an embodiment.

FIG. 20 is a drawing showing a pool with two modules fully inflated, one module semi inflated, and two modules not inflated, according to an embodiment. Two uninflated modules 2001 rest at the bottom of the pool, a semi-inflated module 2002 is being inflated and is rising in the pool, and two inflated modules 2003 are at the top of the pool. As a module inflates, its buoyancy will increase and thus it will naturally rise to the top of the pool. When a module is deflated, it will naturally sink to the bottom of the pool.

Figure 21:
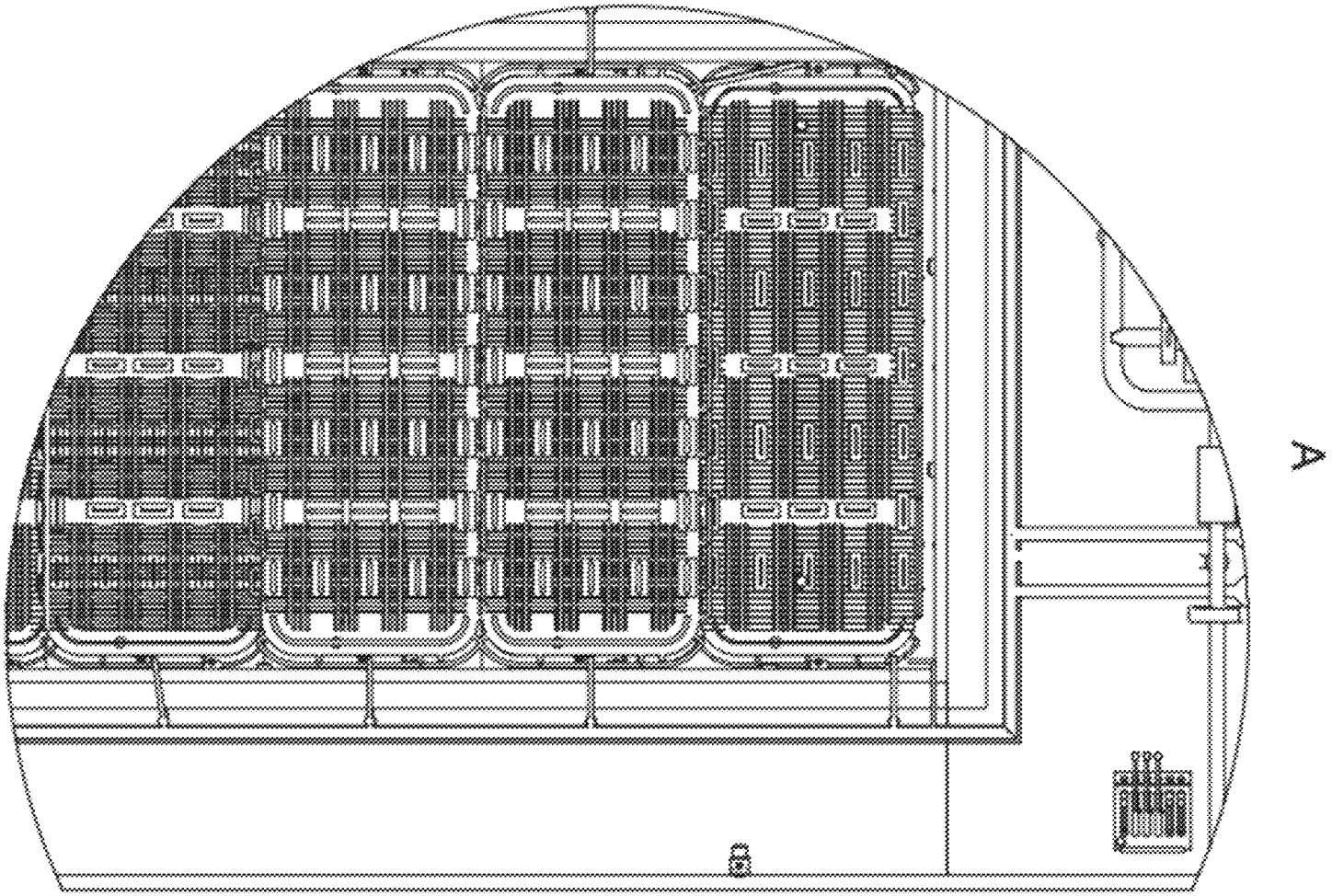
FIG. 21 is a drawing of a top view showing the pool with the two modules fully inflated, one module semi inflated, and two modules not inflated, according to an embodiment.

FIG. 21 is a drawing of a top view showing the pool with the two modules fully inflated, one module semi inflated, and two modules not inflated, according to an embodiment.

Figure 22:
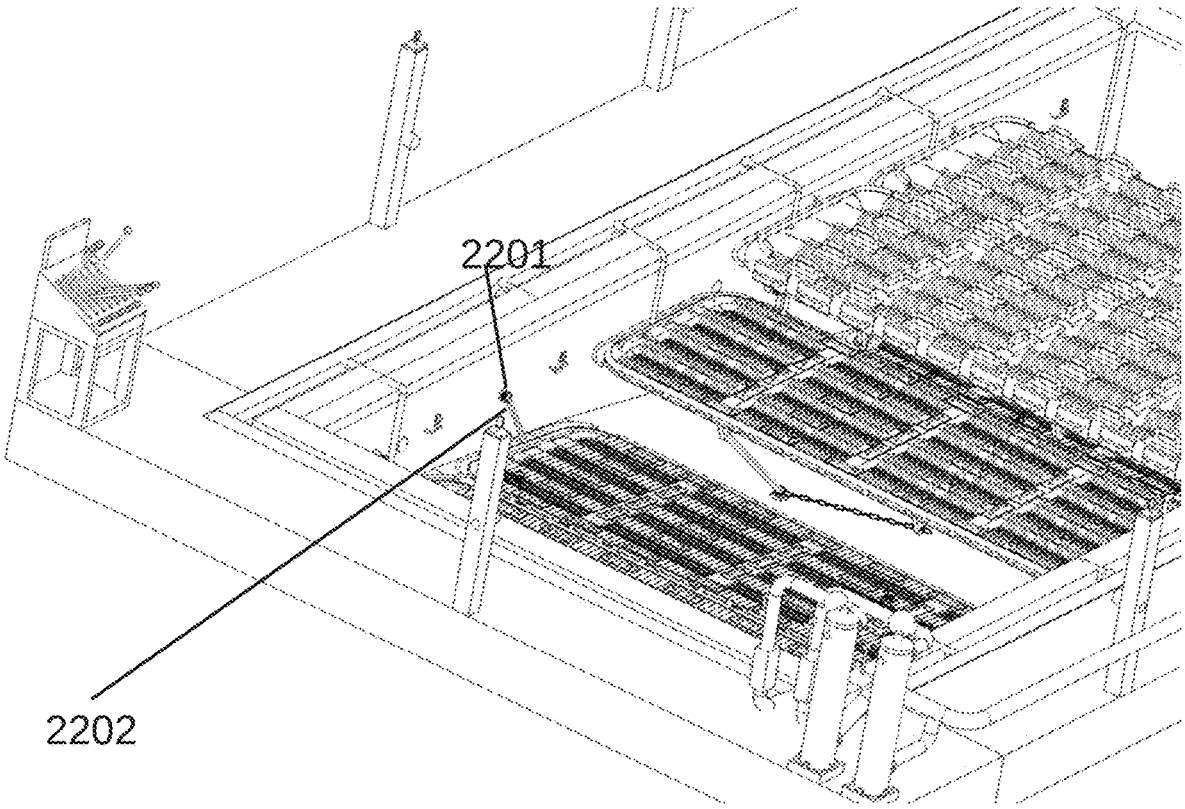
FIG. 22 is a drawing of an isometric view of the pool, according to an embodiment.

FIG. 22 is a drawing of an isometric view of the pool, according to an embodiment.

A side anchor 2201 is attached to the wall of the pool. All anchors can be attached to the pool using a suction attachment (e.g., suction cup), adhesive (e.g., underwater epoxy, silicone sealant, polyurethane adhesives, etc.), screwed in (or otherwise mechanically attached). A side harness 2202 can be an elastic band (e.g., bungee cord) and attaches the anchor to the inflatable net. The harnesses allow each inflatable net to rise and sink but keep it in its place alongside the pool (in other words, the inflatable net can only rise and fall but not otherwise move its location in the pool). The elastic bands can also instead be a spring or have a spring-like character to them so that they apply some downward force towards the inflatable net in order to encourage it to sink when it is not inflated.

Figure 23:
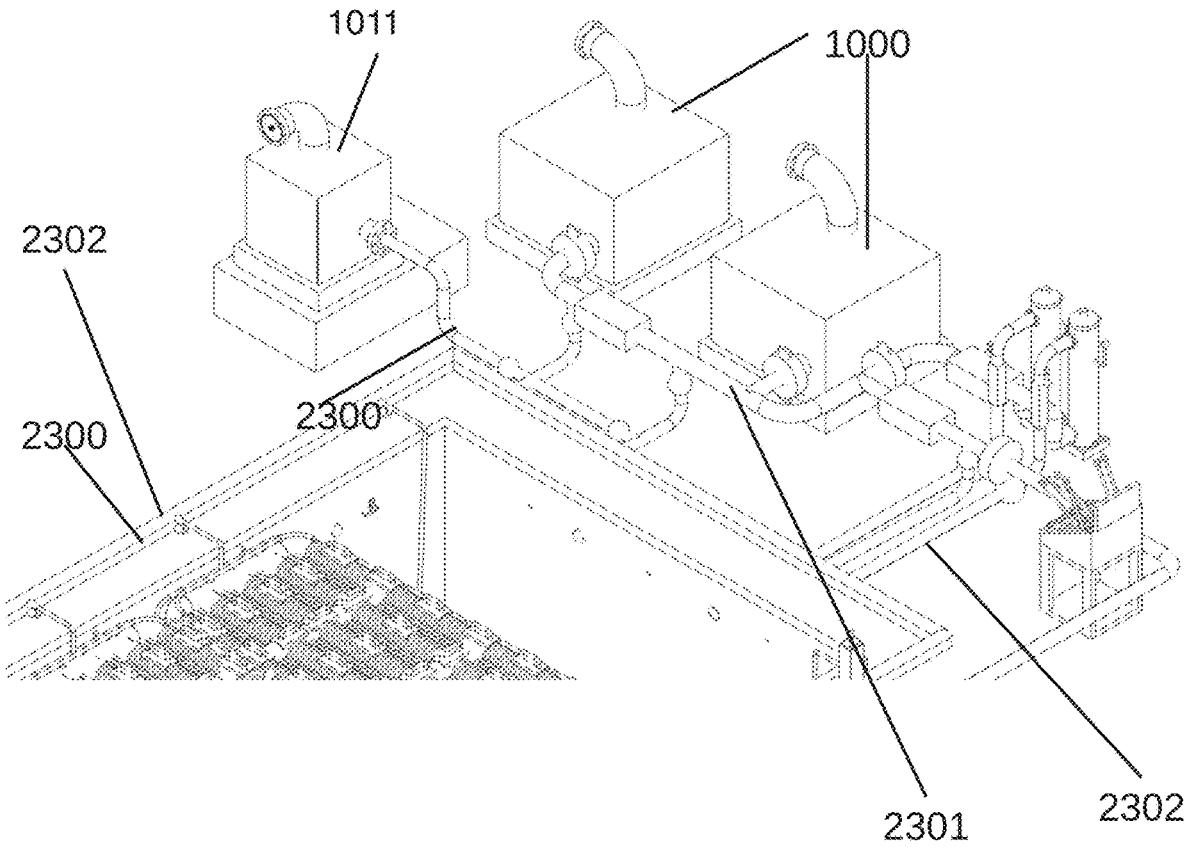
FIG. 23 is a drawing shown an end of the pool with the compressors, control box, blower, compressed air storage tanks, and piping, according to an embodiment.

FIG. 23 is a drawing showing an end of the pool with the compressors, control box, blower/fan, compressed air storage tanks, and piping, according to an embodiment.

Suction piping 2300 connects the blower/fan 1011 to the valves which lead to the inflatable nets and is used to deflate the inflatable nets (upon activation of the blower which sucks the air out of the inflatable nets). Compressor conduit 2301 connects the compressors 1000 to the air tank(s). Air supply piping 2302 connects the air tanks to the inflatable nets (via valves). As can be seen in FIG. 23, the air supply piping 2302 and the suction piping 2300 both connect to the inflatable net, and which piping (if any) allows air to flow therethrough to the inflatable net depends on which valve(s) are open. Typically, the system would not allow both the air supply piping 2302 and the suction piping 2300 to allow airflow to the same inflatable net at the same time.

Figure 24:
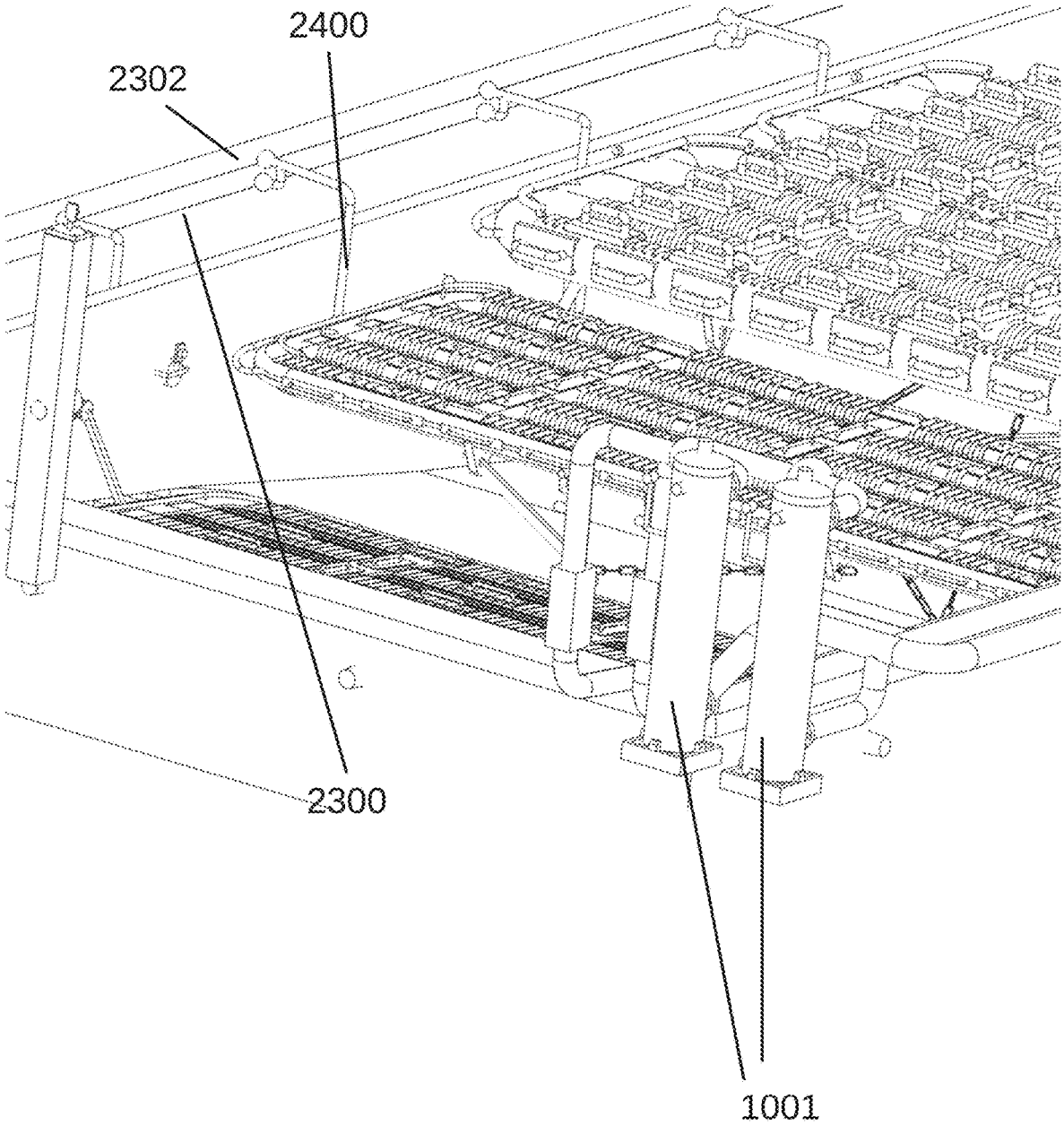
FIG. 24 is a drawing showing supply piping and suction piping, according to an embodiment.

FIG. 24 is a drawing showing supply piping and suction piping, according to an embodiment.

Each inflatable net has at least one air transfer tube 2400 which allows air to flow in (from the air supply piping 2302) and out (to the suction piping 2300). Both the air supply piping 2302 and the suction piping 2300 are connected to each air transfer tube 2400 so air can flow therethrough. Typically, each inflatable net would have an air transfer tube on each side, thereby allowing for inflating and deflating of the inflatable net at twice the speed as only one such air transfer tube 2400.

Figure 25:
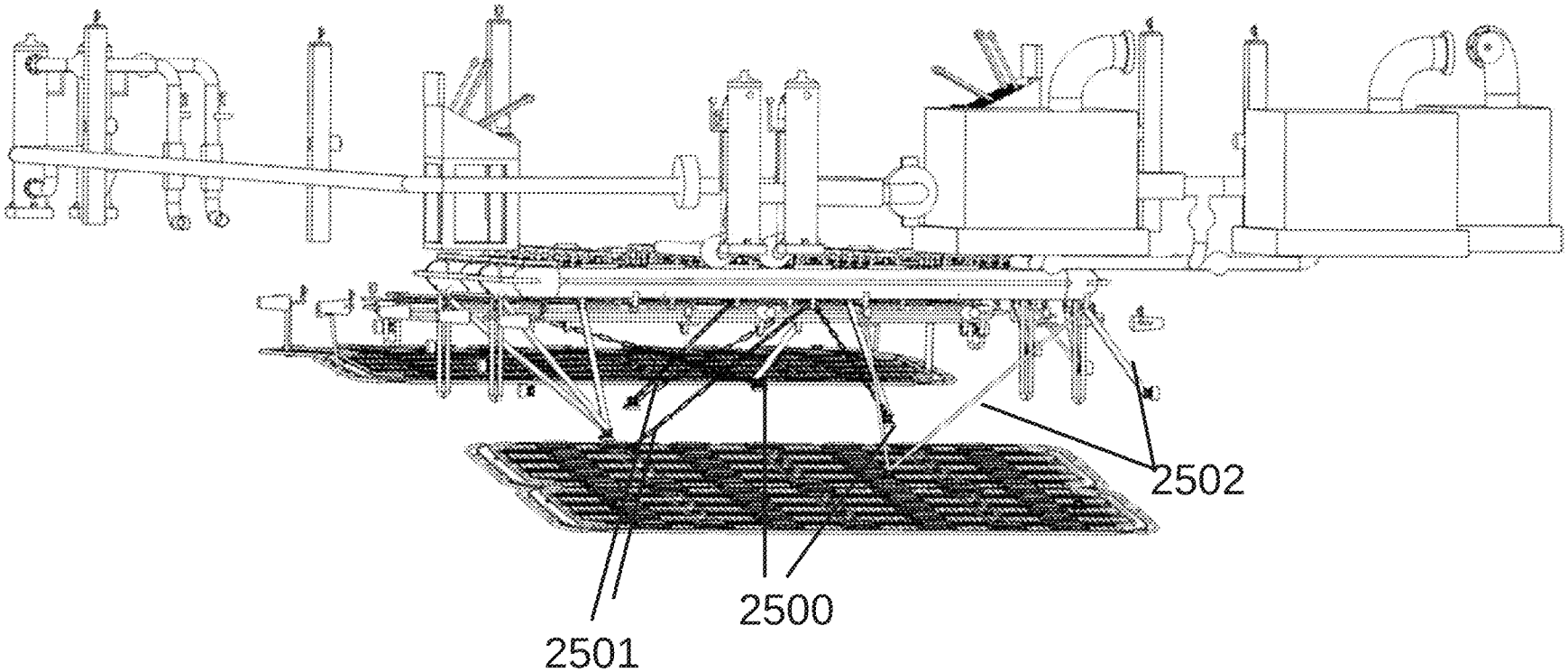
FIG. 25 is a drawing showing elastic cords, chains, elastic bands, and side anchors, according to an embodiment.

FIG. 25 is a drawing showing elastic cords, chains, elastic bands, and side anchors, according to an embodiment.

A plurality of floor anchors 2500 are affixed to the bottom of the pool. As stated herein, all anchors (including side anchors and floor anchors) can be affixed to the pool using any attachment mechanism, such as a suction attachment (e.g., suction cup), adhesive (e.g., underwater epoxy, silicone sealant, polyurethane adhesives, etc.), screwed in (or otherwise mechanically attached). Metal chains 2501 can connect the floor anchors 2500 to the inflatable nets. The metal chains provide weight to the inflatable net which would help cause the inflatable net to sink. The buoyancy and weight distribution of the inflatable nets are such that when each inflatable net is inflated, it will rise to the top of the pool and when it is deflated, it will sink (due to the forces of gravity).

Elastic harnesses 2502 (e.g., made from bungee cord, rubber, or any other elastic material) attach anchors (both side anchors and floor anchors) to various parts of the inflatable nets in order to keep the inflatable nets from drifting away from their designated position in the pool. The elasticity of the elastic harnesses 2502 also serves to provide some "down" force in order to encourage each inflatable net to sink, so that when the inflatable nets are deflated the elastic harnesses helps them to sink to the bottom of the pool, but as stated herein when the inflatable nets are inflated the inflated nets will rise to the top of the pool (and overcome the pull down force of the elastic harnesses as well as gravity). While they are not all numbered, all of the white connectors in FIG. 25 connecting the pool floor to the inflatable nets are elastic harnesses.

Figure 26:
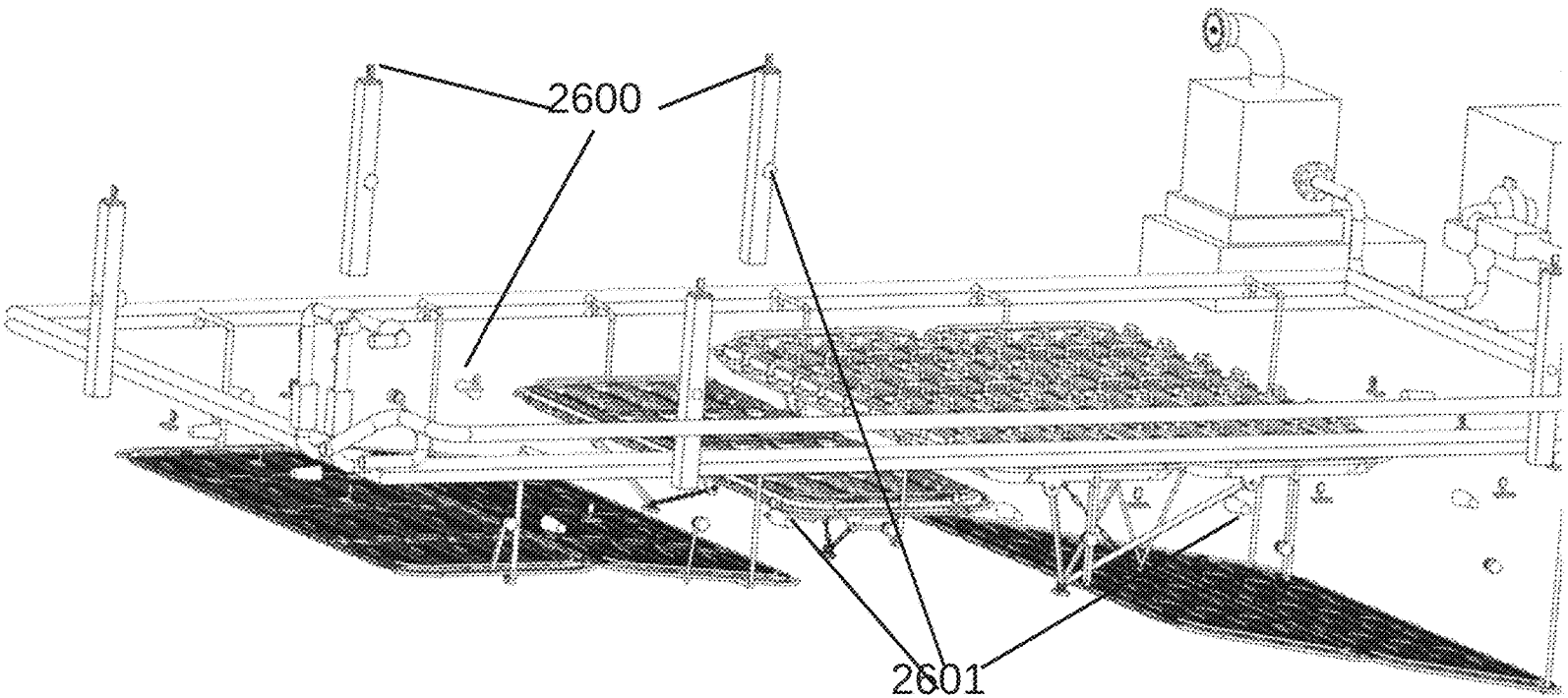
FIG. 26 is a drawing showing above and underwater cameras and above and underwater microphones, according to an embodiment.

FIG. 26 is a drawing showing above and underwater cameras and above and underwater microphones, according to an embodiment.

A plurality of cameras 2600 are located both above the pool and inside the pool (waterproof cameras). A plurality of microphones 2601 are also located both above the pool and inside the pool (waterproof microphones). The cameras 2600 and microphones 2601 can be used to capture and broadcast the live images of the pool to a server and also to authorized apps running on portable devices. The live images and audio can also be stored on a database for later retrieval. The live images and live audio can also be used for artificial intelligence purposes to automatically determine when a swimmer may be in distress in order to raise the respective net that the swimmer is located over.

Figure 27A:
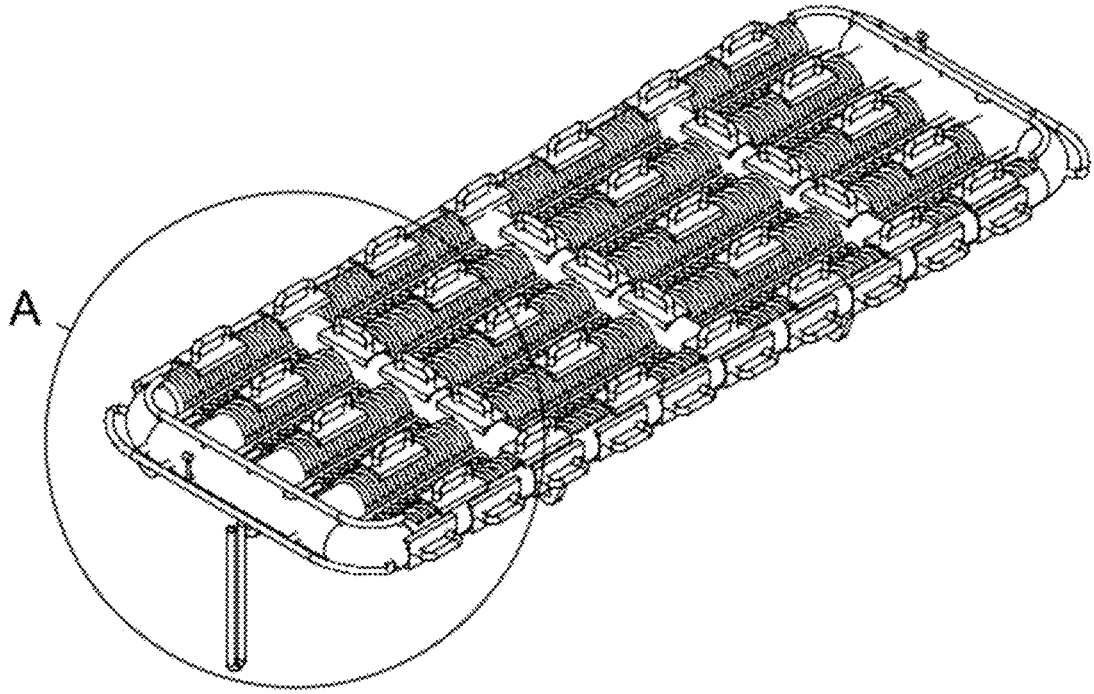
FIG. 27A is a drawing showing an inflated net with air supply piping, according to an embodiment.
Figure 27B:
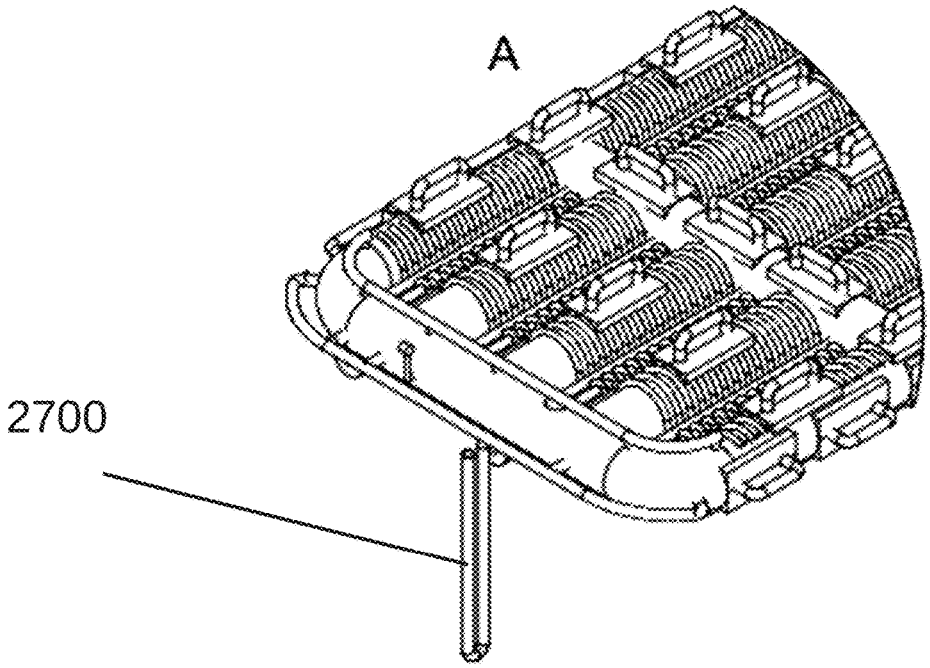
FIG. 27B is a drawing showing an enlarged portion with the air supply piping, according to an embodiment.

FIG. 27A is a drawing showing an inflated net with air supply piping, according to an embodiment. FIG. 27B is a drawing showing an enlarged portion with the air supply piping, according to an embodiment.

Air transfer tube 2700 is used to connect the inside of the inflatable net to both the supply piping and the suction piping. As the inflatable net rises and falls, the air transfer tube 2700 being malleable would remain connected to the inside of the inflatable net so that the air can pass therethrough.

Figure 28A:
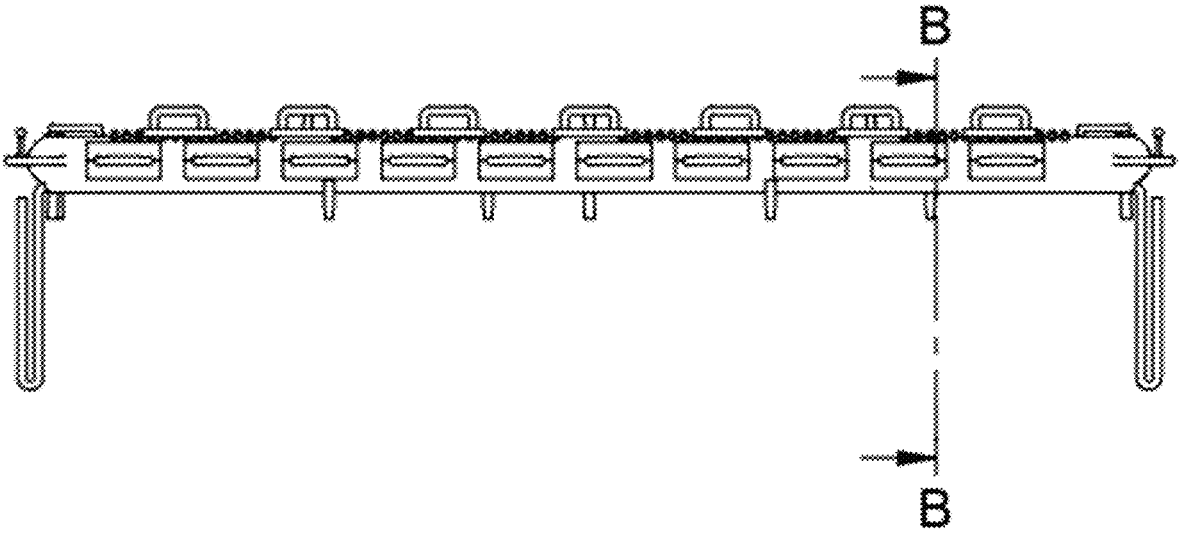
FIG. 28A is a drawing showing an inflated net, according to an embodiment.

FIG. 28A is a drawing showing an inflated net, according to an embodiment.

Figure 28B:
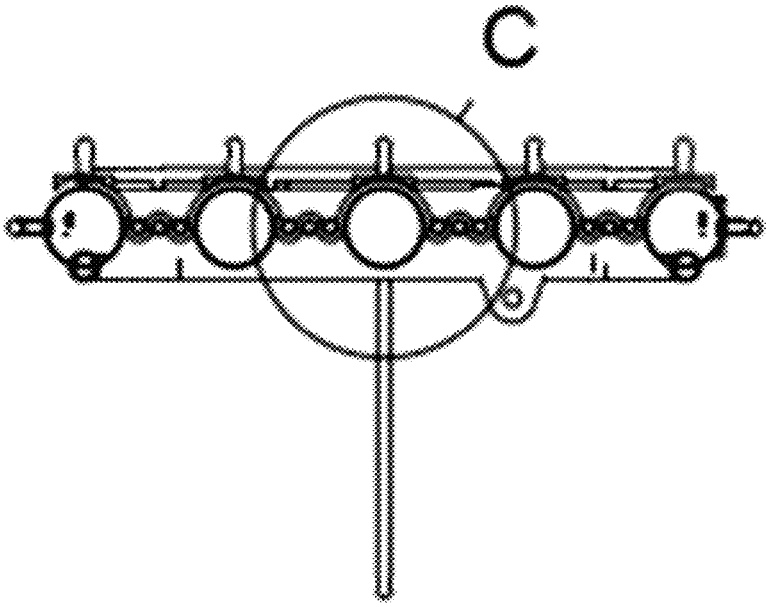
FIG. 28B is a drawing showing a cross section of the inflated net, according to an embodiment.
Figure 28C:
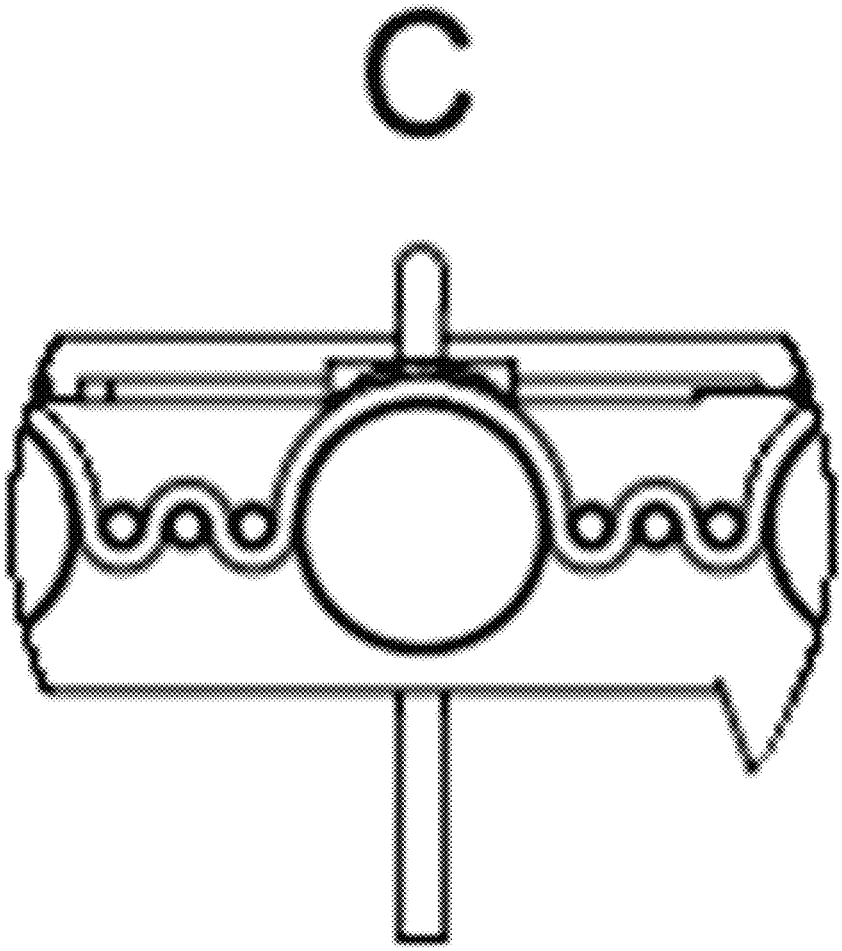
FIG. 28C is a drawing showing a further cross section showing interwoven lattice structure of the inflatable net tubes, according to an embodiment.

FIG. 28B is a drawing showing a cross section of the inflated net, according to an embodiment. FIG. 28C is a drawing showing a further cross section showing interwoven lattice structure of the inflatable net tubes, according to an embodiment.

In FIG. 28B, the air tubes can be seen which comprise each inflatable net and fill up with air when the inflatable net is inflated. In FIG. 28C, the interwoven lattice structure of the inside of each inflatable net tube can be seen.

Figure 29:
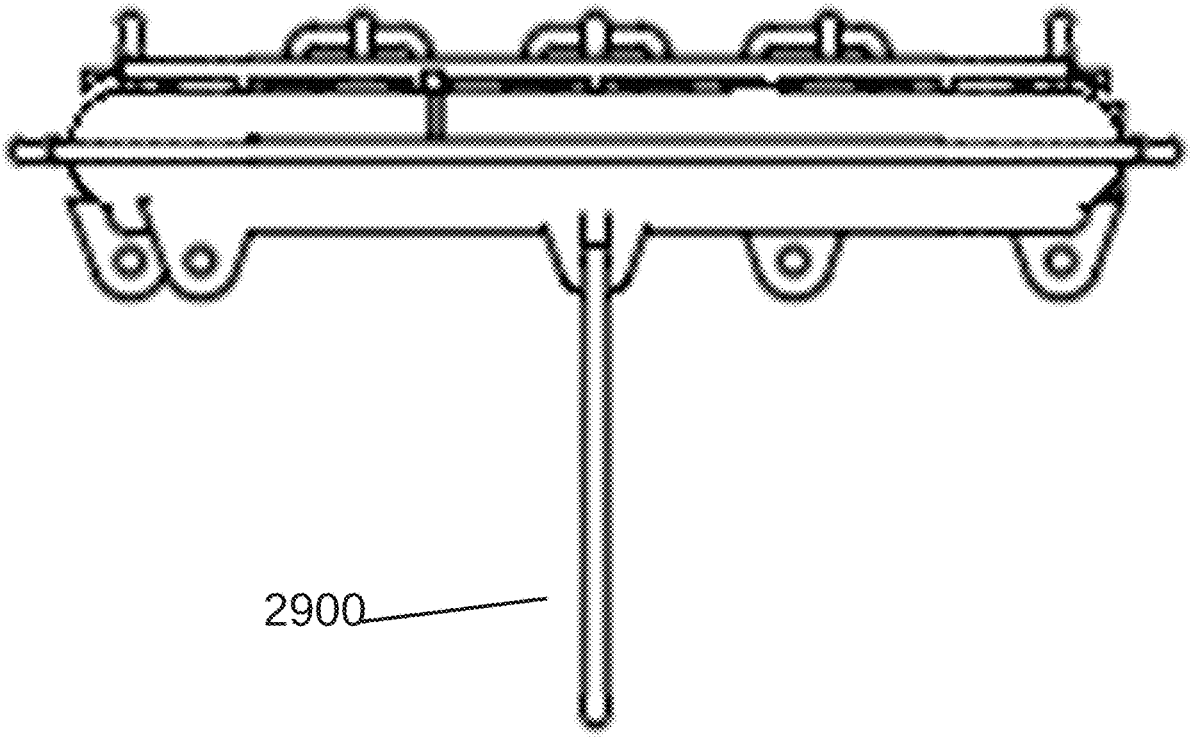
FIG. 29 is a drawing showing a side view of the inflatable net, according to an embodiment.

FIG. 29 is a drawing showing a side view of the inflatable net, according to an embodiment.

The air transfer tube 2900 is visible. An air transfer tube 2900 would typically be present on each end of the inflatable net.

Figure 30A:
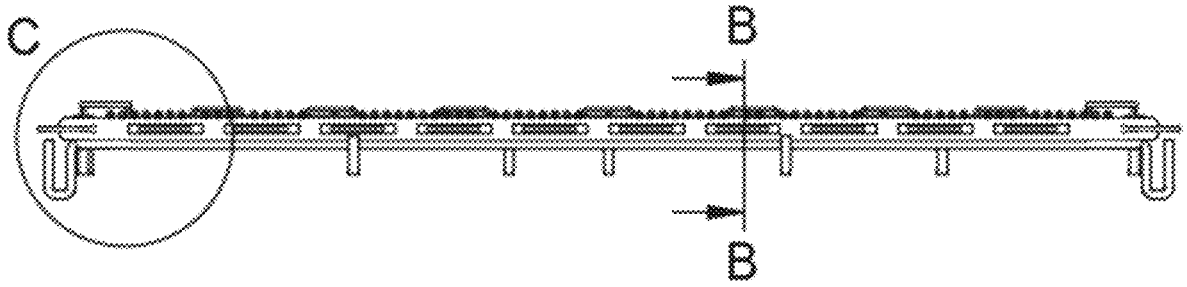
FIG. 30A is a drawing showing a front view of a semi inflated inflatable net, according to an embodiment.
Figure 30B:
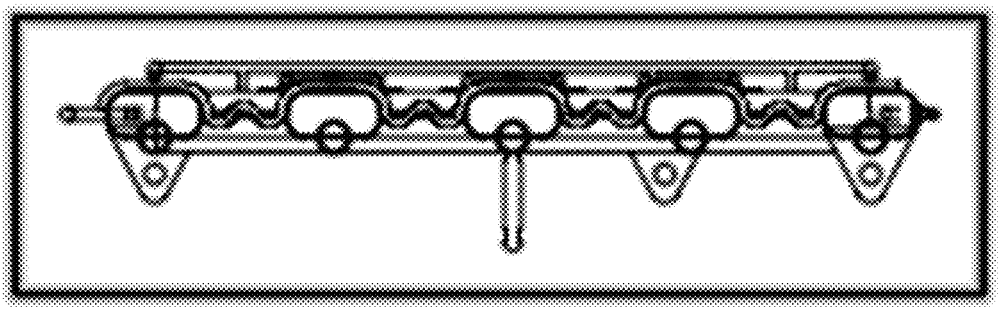
FIG. 30B is a drawing showing a cross section of the semi inflated inflatable net, according to an embodiment.
Figure 30C:
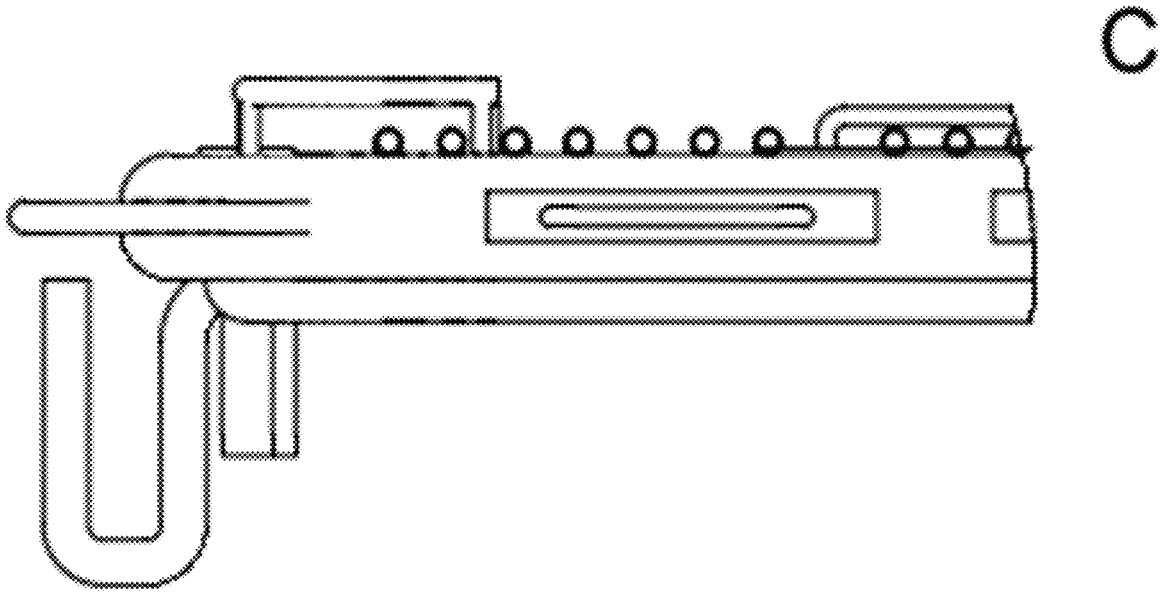
FIG. 30C is a drawing showing a further cross section of the semi inflated inflatable net, according to an embodiment.

FIG. 30A is a drawing showing a front view of a semi inflated inflatable net, according to an embodiment. FIG. 30B is a drawing showing a cross section of the semi inflated inflatable net, according to an embodiment. FIG. 30C is a drawing showing a further cross section of the semi inflated inflatable net, according to an embodiment.

Figure 31:
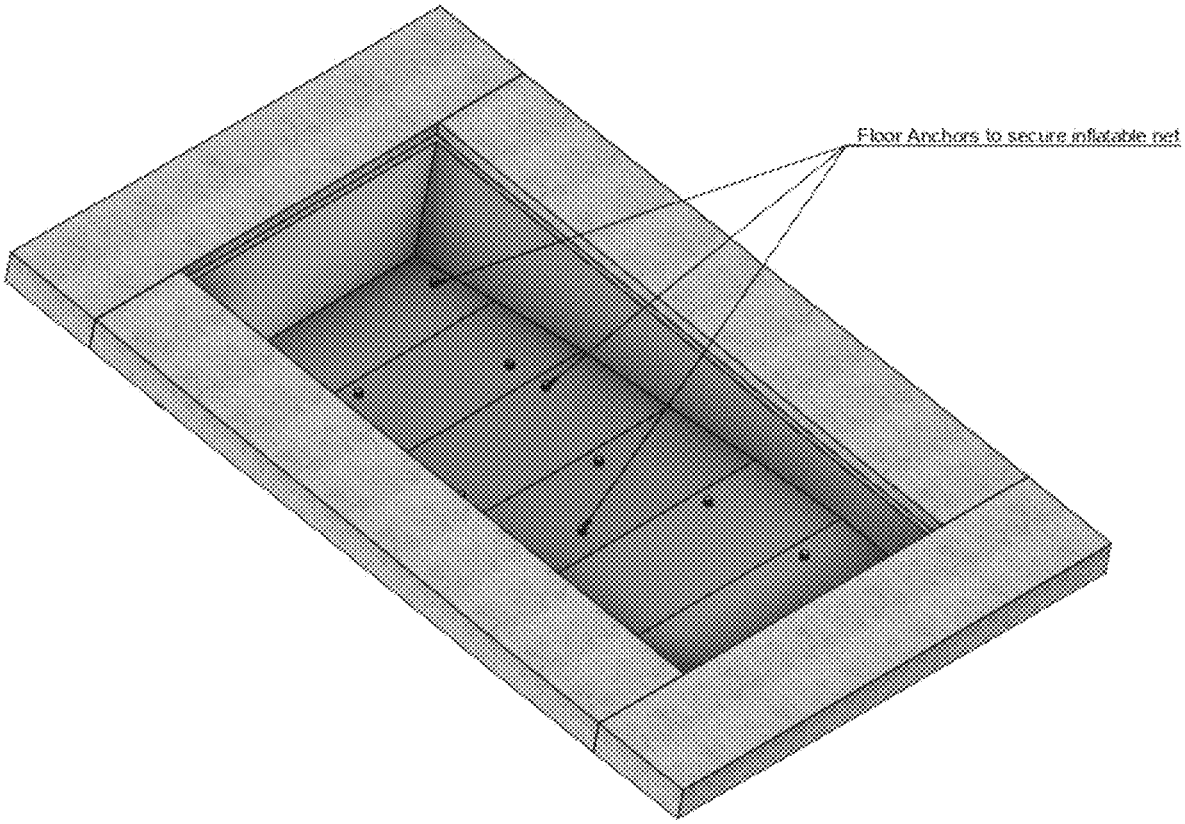
FIG. 31 is a drawing of a bottom of a pool, according to an embodiment.

FIG. 31 is a drawing of a bottom of a pool, according to an embodiment. Floor anchors (shown in FIG. 31) are attached (e.g., via mechanical connector such as a screw, adhesive, etc.) to the floor (bottom) of the pool which are then connected to the modules. The floor anchors and the modules can be connected via elastic rope (e.g., bungee), chains, ropes, etc. The connection would allow the module to rise, but typically not to move in a sideways direction (e.g., orthogonal to the up/down direction).

Figure 32:
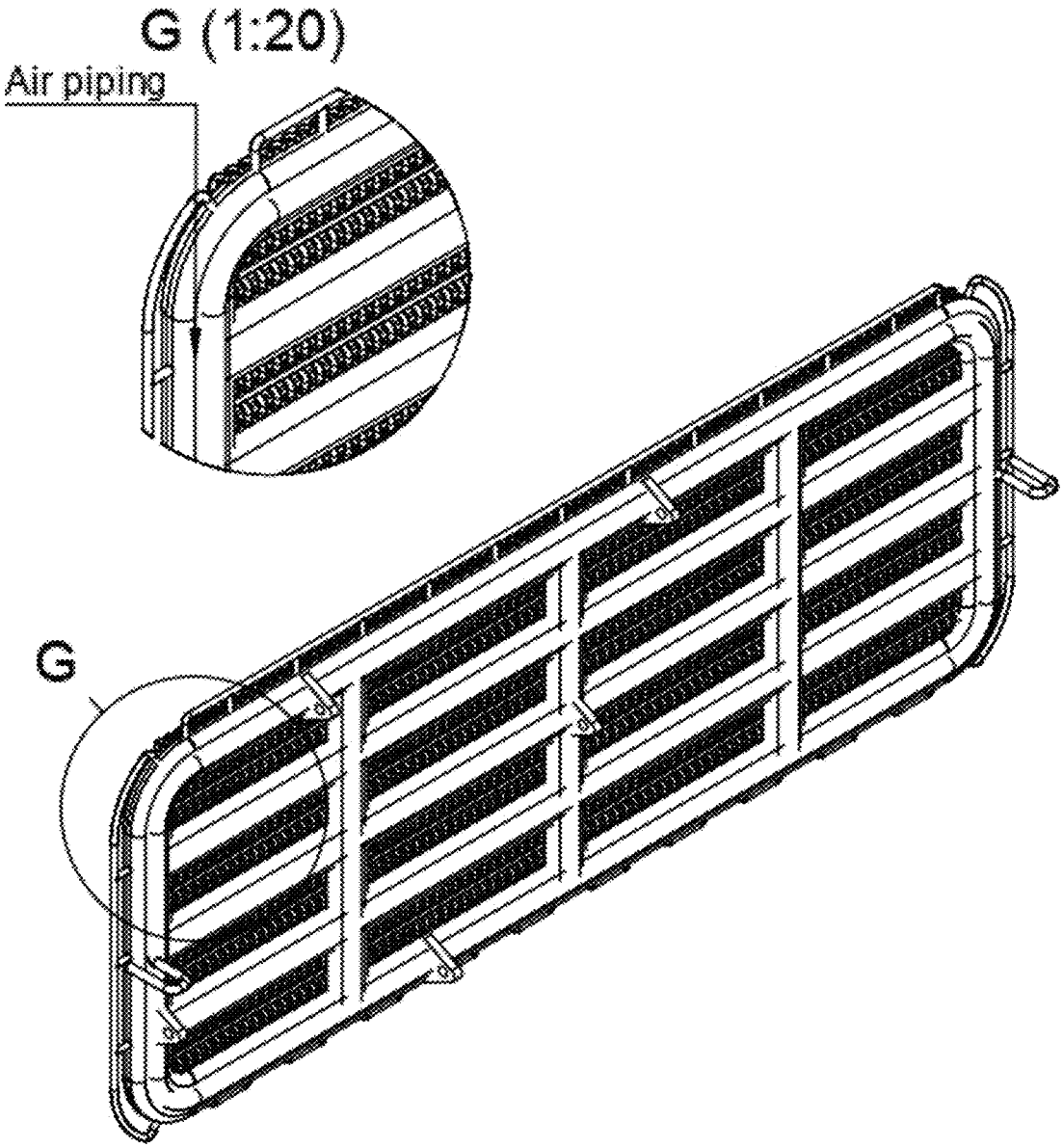
FIG. 32 is a drawing showing a bottom of a semi inflated module showing piping underneath the module, according to an embodiment.

FIG. 32 is a drawing showing a bottom of a semi inflated module showing piping underneath the module, according to an embodiment. Typically, pools are sloped downward towards the deep end. The connections between the floor anchors and the modules should take into consideration the depth of the floor anchor so that the connection would be long enough to enable its module to rise to the top of the pool, but the connection should not have extra length. Piping connectors connect the tubes (and other air containing structures of the modules) to the supply piping and the suction piping.

Figure 33:
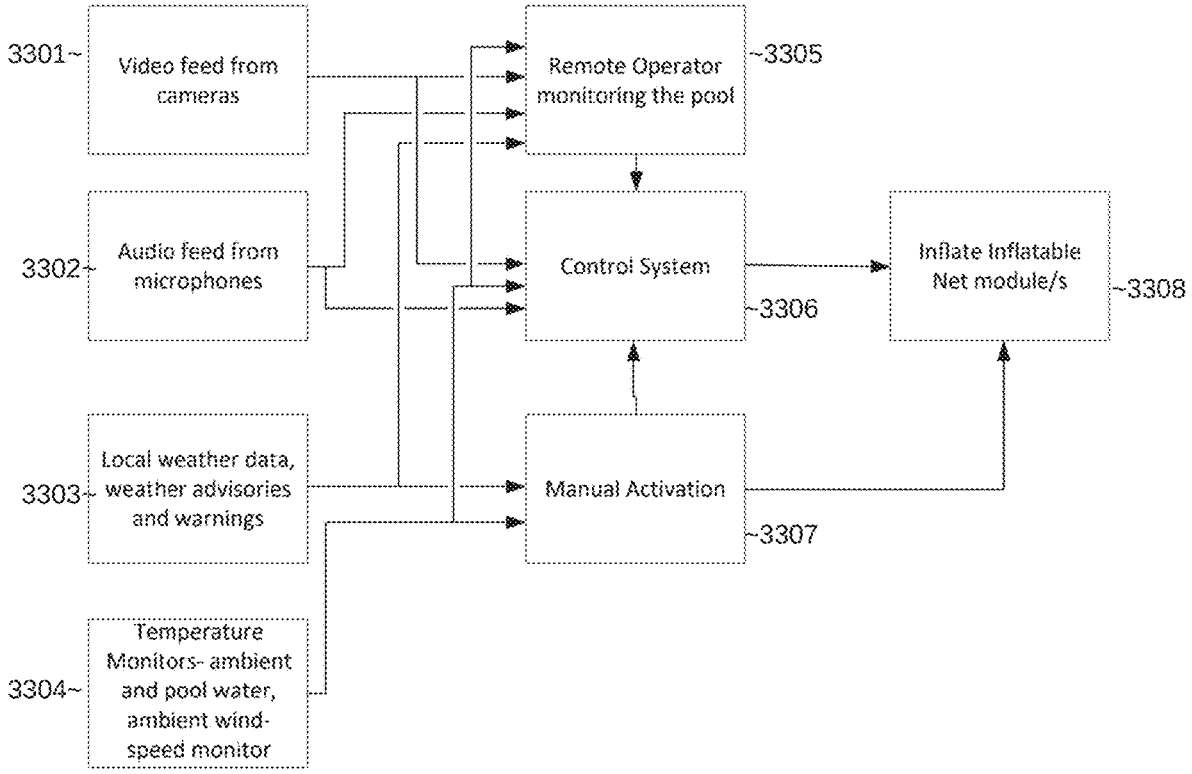
FIG. 33 is schematic showing how weather conditions can be incorporated into the system, according to an embodiment.

FIG. 33 is schematic showing how weather conditions can be incorporated into the system, according to an embodiment.

The inflatable net control system can be programmed to prevent accidental deaths or injury to people in the swimming pool. During winter season when the ambient temperature is closer to freezing and the pool water is hazardous to swimming due to onset of hypothermia, conditions such as brain hemorrhage etc., the inflatable net control system using the video cameras, microphones, local weather data and related advisories and warnings and temperature monitors can monitor the pool for the presence of humans or pets and trigger the inflatable net to protect the humans or pets. The inflatable net could also be triggered manually if a concerned human at the pool notices anyone in danger. The inflatable net system can send out notifications to responsible people notifying them of the incident to get the required help.

In the case of a thunder storm, lightning or rain or heavy winds when it is not safe for humans or pets to be in the pool, the inflatable net control system using the video cameras, microphones and local weather data and related advisories and warnings can monitor the pool for the presence of humans or pets and trigger the inflatable net to protect the humans or pets. The inflatable net could also be triggered manually if a concerned human at the pool notices anyone in danger or if anyone is present in the pool when they should not be in it. The inflatable net system can send out notifications to responsible people notifying them of the incident to get the required help.

A video feed 3301 from cameras and an audio feed 3302 from microphones can be transmitted to the control system 3306. The control system 3306 can include the processing unit 1400 and all other computing hardware connected to it. As described herein, the control system 3306 can automatically monitor the video feed 3301 and audio feed 3302 and make an automatic determine (using artificial intelligence such as neural networks, etc.) whether to activate (raise) any of the modules (and which particular module to raise depending on where the distressed swimmer is located). When it is automatically determined that there is a swimmer in distress, the control system 3306 can automatically inflate 3308 the module(s) to assist the distressed swimmer, but if the control system 3306 does not make such an automatic determination that there is a distressed swimmer then it would not inflate any of the modules. The modules can also be raised and lowered (and any other state of the system can be changed) via manual activation 3307 as well (e.g., control panel, cell phone or tablet 1701 running a control app, etc.)

Figure 34:
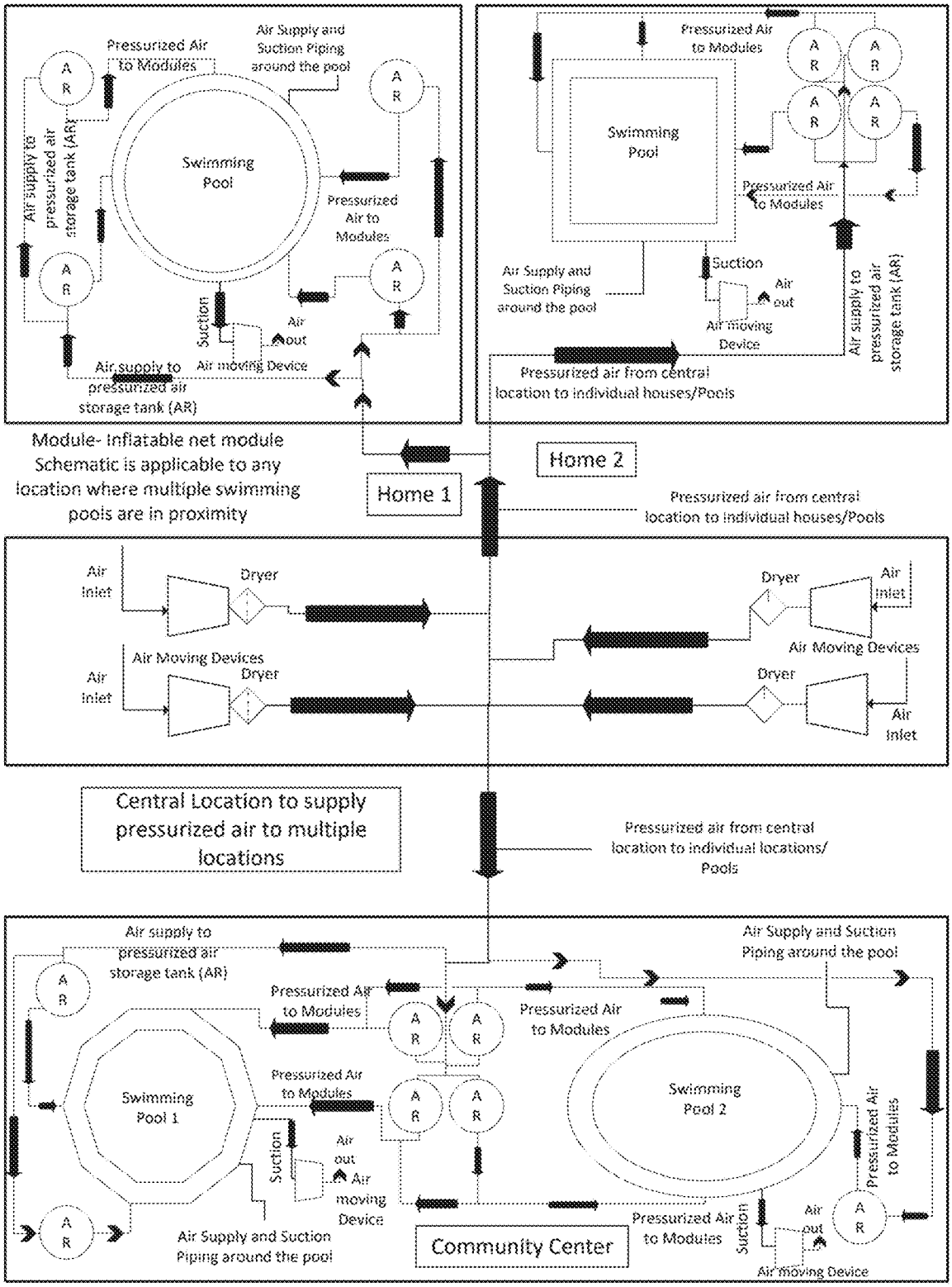
FIG. 34 is a block diagram showing how multiple pools can share some resources to implement embodiments described herein, according to an embodiment.

A remote operator 3305 can also manually activate any of the modules using controls (e.g., see FIG. 34). For example, the remote operator can be using a cell phone connected via the internet (or other computer communications network) to view both video feed (and listen to audio feed) from the pool area, issue any instruction(s) remotely to the system that can be performed using the physical controls at the pool site.

Note that local weather data, weather advisories, and warnings 3303 can be input into the control system 3306 as well so that the control system 3306 can automatically utilize this system in its artificial intelligence decision making process. For example, weather reports can be retrieved from the internet, and if the wind speed is high, and the control system 3306 detects a borderline case of a distressed swimmer, the fact that the weather is dangerous would cause the system to inflate a module(s) that it wouldn't inflate if the weather report had not been poor.

In addition, temperature monitors (both in the air and in the water) can be utilized as well as a wind speed monitor. All of this data can be determined via sensors located at the pool area (and/or inside the pool) and the readings of the sensors can be transmitted to the control system 3306 wherein it can then be utilized to assist its automatic determination of whether to inflate a module(s). For example, if the water temperature is abnormally low, and the control system detects a borderline case of a distressed swimmer, then the low water temperature would cause the system to inflate the respective module(s) whereas if the water temperature was not low then it would not have inflated the respective module(s). As such, the control system 3306 would utilize sensor data (e.g., temperate in the air and/or water), and wind speed (and any other such current condition) when making automatic artificial intelligence based decisions on whether to raise module(s).

FIG. 34 is a block diagram showing how multiple pools can share some resources to implement embodiments described herein, according to an embodiment.

Note that some pools can share resources which can be utilized in order to implement embodiments described herein. For example, if there are two pools in two different (but near each other) locations, the different pools can share assets like air moving devices, dryers, compressors, etc. In this embodiment, different pools can share assets such as a compressor to fill each pool's pressured air tanks, thus saving on money and installation costs.

Figure 35:
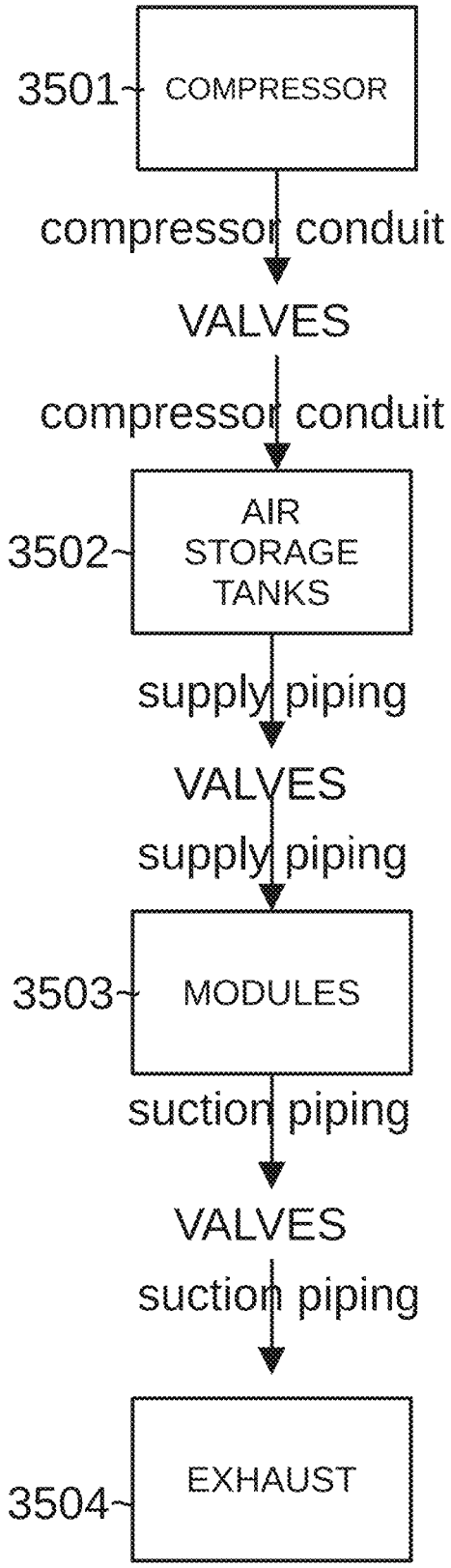
FIG. 35 is a block diagram illustrating how different physical connections are related in order to move and process air, according to an embodiment.

FIG. 35 is a block diagram illustrating how different physical connections are related in order to move and process air, according to an embodiment.

One or more compressor(s) 3501 supplies compressed air to the air storage tank(s). Note that compressor conduits are pipes which are used to deliver the compressed air to the air storage tanks. Note that one (or more) compressors can deliver compressed air to multiple air storage tanks. Valves (e.g., ball valves, butterfly valves, solenoid valves, etc.) can be electronically controlled/switched (e.g., by the control system, processing unit, etc.) to direct the air flow to intended air storage tank(s).

Once compressed air is in the air storage tanks 3502, it can be supplied to the module(s) to inflate the module(s) via pipes referred to as supply piping by electronically initiating the airflow (e.g., by opening valves, etc.) The supply piping has its own set of valves (e.g., ball valves, butterfly valves, solenoid valves, etc.) which are electronically controlled/switched by the control system, processing unit, etc.) to direct the air into the intended module(s). Different valves along the path would be switched in order to make sure the compressed air flows into the respective module(s), and when the module(s) is fully inflated then the air flow can be turned off electronically. The air used to inflate the module(s) (channel air from the air storage tank(s) to the module(s)) can be moved by air moving devices such as fans, blowers, etc.

Once air is in the module(s) 3503 and it is time to deflate the module(s), then piping referred to herein as suction piping can be used to direct the air out of the modules and pumped into the air. Suction piping also uses a network of valves in order to direct the air from the respective module(s) to be deflated through the suction piping and thereafter exhausted 3504 into the air. The valves (e.g. ball valves, butterfly valves, solenoid valves, etc.) can all be electronically controlled (e.g., by the control system, processing unit, etc.) to direct the air through the respective suction piping so that the air is suctioned out of the module(s) and channeled through the suction piping into the air. Once the air is sucked out of a module, the module should automatically sink back down to the bottom of the pool. The air used to deflate the module(s) (channel air through the suction piping into the exhaust) can be moved by air moving devices such as fans, blowers, etc.

Note that in an embodiment, suction piping and supply piping can share some (or all) of the same pipes, and the flow (into the module(s) or out) is controlled by the respective valve position(s). The processing unit can open and close each valve individually, therefore paths in all of the types of piping can be defined. In another embodiment, the supply piping and the suction piping are entirely separate pipes altogether. All pipes can be made of any suitable material, such as metal (e.g., galvanized steel, aluminum, etc.) or plastic (e.g., PVC, ABS, etc.) The pipes would be hollow and all connected hermetically (airtight) in order to carry the air throughout the system without the air leaking into the outside. By using separate pipes for supply and suction piping, the other inflatable net modules are available in watch mode to protect humans and pets while one of the module is being deflated. In the event of a potential drowning incident in a different location of the pool when one of the modules is being deflated, the separate piping for air supply would allow the system to activate the other inflatable net modules located underneath the distressed swimmer. The separate piping would allow the pressurized air from storage tanks to flow into the respective module/s thereby inflating the required modules and saving the distressed swimmer.

Figure 36:
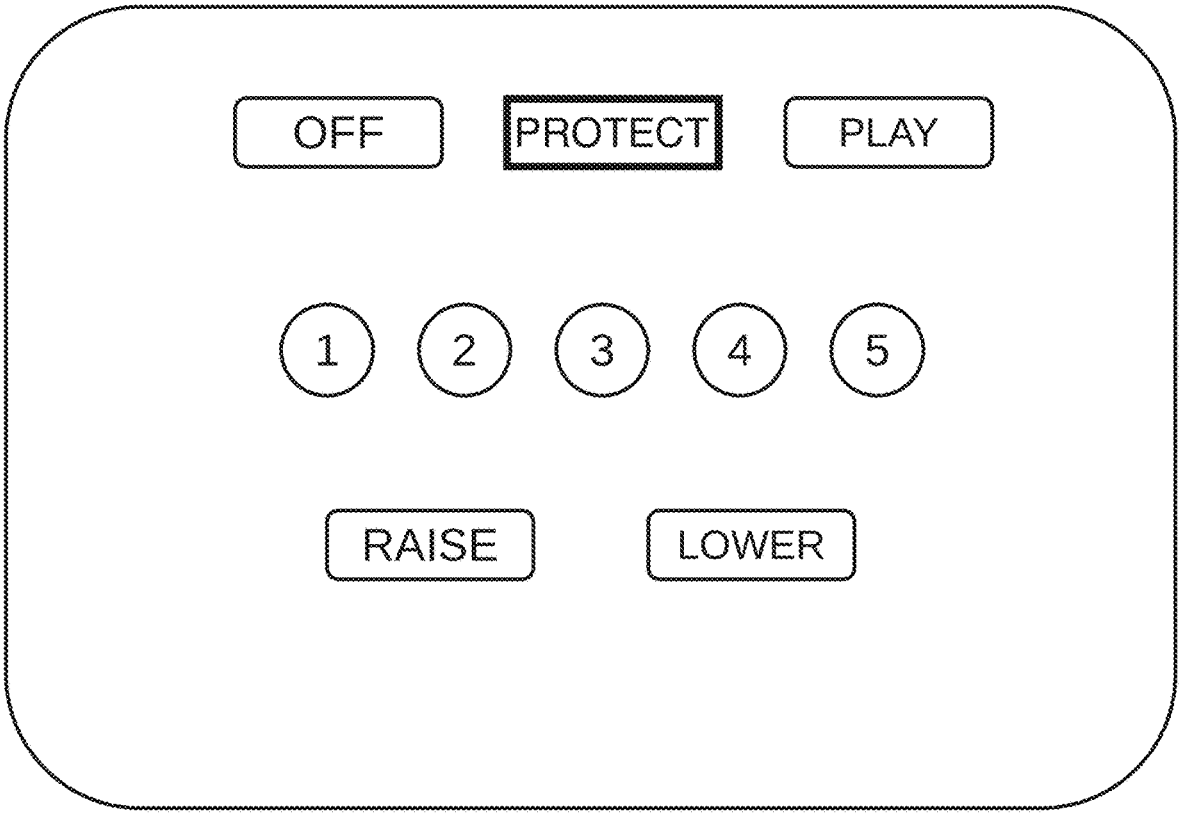
FIG. 36 is an example output of a digital control system to control the system, according to an embodiment.

FIG. 36 is an example output of a digital control system to control the system, according to an embodiment, The processing unit 1400 can implement a graphical user interface (GUI) on its input unit 1401 and output unit 1402

(which can both be the same touch-screen) which enables an operator to manually control the system. For example, the operator can choose to set the watch mode or play mode (or any other mode described herein). The operator can press one of a number of buttons (shown in FIG. 36 as 1, 2, 3, 4, 5) to designate which module to raise/lower. A raise button and a lower button can be used to raise and lower the designated module.

For example, if the operator sees a distressed swimmer in the pool over module 2, the operator would first make sure to put the system in the protect mode by pressing the "protect" button. Then the operator would press the '2' button to indicate he/she wishes to activate module 2. Then the operator would press the "raise" button to raise module 2 (however the other modules would not be affected) in order to cause module 2 to inflate and rise to the surface of the pool, thereby lifting the distressed swimmer. Once the distressed swimmer is rescued and removed from the pool, the operator can then press the "lower" button to deflate module 2 which would cause module 2 to sink back down to the bottom of the pool.

In a location that has multiple swimming pools located in proximity to one another and that have inflatable nets installed in all or several of those pools, the number of air moving devices (e.g., blowers, compressors, air tanks, etc.) can be optimized to serve all those swimming pools from a central location. For example—residential homes, multi-family housing/apartment complex, commercial establishments (such as hotels, professional clubs, resorts, training facilities), educational institutions (schools, colleges, universities), medical facilities (nursing homes, hospitals etc.) and other community and commercial centers that have multiple swimming pools in a location or campus can be serviced from a central location using piping network comprising of manifolds, air receivers (pressurized air storage tanks), valves and other humidity, pressure, volume and temperature sensing instrumentation. As such, some of the air moving devices (e.g., blowers, compressors, air tanks, etc.) can be shared among multiple pools.

All features described herein can be implementing using a computerized system as described herein. All electronic features/methods can be programmed and stored on a non-transitory (e.g., disc, EPROM, flash memory, etc.) computer readable storage medium, that when executed by an electronic processor (or multiple such electronic processors working cooperatively), would cause the electronic processor(s) to implement all such features/methods.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

an air tank;

a first inflatable net comprising a lattice structure of first inflatable tubes;

a second inflatable net comprising a lattice structure of second inflatable tubes;

an electronic processing unit configured to read computer readable instructions from a non-transitory computer readable storage medium, the computer readable instructions, when executed by the electronic processing unit, cause the electronic processing unit to:

receive an inflate command identifying a selected net out of a set comprising the first inflatable net and the second inflatable net;

transmit a signal to initiate inflation of the selected net using air from the air tank.

2. The apparatus as recited in claim 1, wherein the electronic processing unit is further configured such that the signal is transmitted to a valve controlling air flow from the air tank.

3. The apparatus as recited in claim 1, further comprising a pool, wherein the first inflatable net and the second inflatable net rest on a bottom of the pool, wherein the first inflatable net and the second inflatable net are both configured such that upon being inflated would rise to a top of the pool.

4. The apparatus as recited in claim 3, further comprising, an anchor attached to the pool, and a harness attaching the first inflatable net to the anchor.

5. The apparatus as recited in claim 4, wherein the harness is made from an elastic material.

6. The apparatus as recited in claim 4, wherein the anchor is attached to a bottom of the pool.

7. The apparatus as recited in claim 1, further comprising a blower or fan, and the computer readable instructions are further programmed to cause, when executed, the blower or fan to activate and deflate the selected net.

8. The apparatus as recited in claim 7, further comprising suction piping linking the first inflatable net and the blower; and an electronic suction valve on the suction piping controlling air flow out of the first inflatable net, the suction valve being configured to open and close in response to a deflate signal received from the electronic processing unit.

9. The apparatus as recited in claim 1, further comprising, a compressor, and the computer readable instructions are further programmed to cause, when executed, the compressor to activate and fill the air tank with air.

10. The apparatus as recited in claim 9, further comprising, a compressor conduit linking the compressor to the air tank.

11. The apparatus as recited in claim 1 further comprising, an air supply piping linking the air tank to the first inflatable net; and an electronic supply valve on the air supply piping controlling air flow into the first inflatable net, the electronic supply valve being configured to open and close in response to an inflate signal received from the electronic processing unit.

12. The apparatus as recited in claim 1, wherein the computer readable instructions are further configured to enable a portable computing device to display a graphical user interface and enable an operator to issue a command to inflate the selected net and deflate the selected net from the portable computing device.

13. The apparatus as recited in claim 12, further comprising a plurality of video cameras located at various locations around a pool and configured to monitor the pool.

14. A method, comprising:

executing computer readable instructions on an electronic processing unit read from a non-transitory computer readable storage medium, causing:

transmitting an inflate signal;

in response to the inflate signal, an air tank inflates a first inflatable net located in a pool and does not inflate a second inflatable net located in the pool; and the first inflatable net rises in the pool in response to being inflated, wherein, the second inflatable net does not rise in response to the inflate signal, wherein the first inflatable net comprises a lattice structure of first inflatable tubes and the second inflatable net comprise a lattice structure of second inflatable tubes.

15. The method as recited in claim 14, further comprising:

issuing a deflate command;

in response to the deflate command, a blower activates causing the first inflatable net to deflate; and the first inflatable net sinks in the pool in response to being deflated.

16. The method as recited in 14, wherein the inflate signal is transmitted to a valve controlling air flow from an air tank.

17. The method as recited in claim 14, further comprising, transmitting a refill signal to a compressor, and activating the compressor in response to the refill signal which refills the air tank with compressed air from the compressor.

18. The method as recited in claim 14, further comprising receiving an inflate command which identifies the first inflatable net from an operator which causes the transmitting the inflate signal.

19. The method as recited in claim 18, wherein the inflate command is received from the operator on a control box located at a pool site.

20. The method as recited in claim 18, wherein the inflate command is received from the operator using a portable computing device.

* * * * *